United States Patent [19]

Sato et al.

[11] Patent Number: 4,951,643

[45] Date of Patent: Aug. 28, 1990

[54] FUEL VAPOR TREATMENT APPARATUS

[75] Inventors: Hidenori Sato, Kariya; Takashi Umeno, Chiryu; Michiyasu Nosaka, Kariya; Nobuhiko Koyama, Nagoya, all of Japan

[73] Assignee: Nippondenso Co., Ltd., Kariya, Japan

[21] Appl. No.: 245,166

[22] Filed: Sep. 16, 1988

[30] Foreign Application Priority Data

| | | | |
|---|---|---|---|
| Sep. 16, 1987 | [JP] | Japan | 62-231348 |
| Mar. 28, 1988 | [JP] | Japan | 63-73973 |
| Mar. 29, 1988 | [JP] | Japan | 63-75553 |
| Jul. 20, 1988 | [JP] | Japan | 63-180827 |

[51] Int. Cl.[5] ..... F02M 39/00

[52] U.S. Cl. ..... 123/520; 123/519

[58] Field of Search ..... 123/518, 519, 520, 521; 55/307, 527, 464, 419, 418, 387

[56] References Cited

U.S. PATENT DOCUMENTS

| | | | |
|---|---|---|---|
| 3,730,158 | 5/1973 | St. Amand | 123/519 |
| 4,308,840 | 1/1982 | Hiramatsu | 55/387 |
| 4,454,849 | 6/1984 | Mizuno et al. . | |
| 4,742,809 | 5/1988 | Ito | 223/519 |
| 4,750,465 | 6/1988 | Rediker | 123/519 |

FOREIGN PATENT DOCUMENTS

| | | |
|---|---|---|
| 53-51506 | 5/1978 | Japan . |
| 53-162214 | 12/1978 | Japan . |
| 56-129561 | 10/1981 | Japan . |

OTHER PUBLICATIONS

'79 Model Ford Shop Manual, Fuel Tanks and Lines, 24–50–5.

*Primary Examiner*—Carl Stuart Miller

*Attorney, Agent, or Firm*—Cushman, Darby & Cushman

[57] ABSTRACT

A fuel vapor treatment apparatus for a vehicle for absorbing the fuel vapor emanating from a fuel tank has a diffusing chamber at the portion into which an inlet port opens. The fuel vapor introduced through the inlet port diffuses in this diffusing chamber, by which the component of the fuel vapor velocity in the direction in which the fuel vapor is adsorbed by the adsorbent is reduced. In consequence, the capability with which the canister adsorbs the fuel vapor is increased so as to allow a large volume of fuel vapor which flows at a high flow rate to be adsorbed.

9 Claims, 22 Drawing Sheets

| | ABSORBING AND REMOVING ABILITY | ABSORBING AND REMOVING ABILITY OF ACTIVATED CHARCOAL PER LITER | RATE |
|---|---|---|---|
| SAMPLE 1 4 l | 195 g | 48.8 g/l | 100 |
| SAMPLE 2 3.5 l | 188 g | 53.7 g/l | 110 |
| PRESENT INVENTION 3.5 l | 209 g | 59.7 g/l | 122 |

FUEL VAPOR TREATMENT APPARATUS

BACKGROUND OF THE INVENTION

The present invention relates to a fuel vapor treatment apparatus (hereinafter referred to as a canister) for absorbing the fuel vapor emanating from the fuel reservoir chamber of a vehicle such as a fuel tank so as to limit gasoline vapor discharge into the atmosphere.

A conventional canister of the above-described type is disclosed in Japanese Unexamined Utility Model Publication No. 53-162214. In this canister, the fuel vapor from the fuel tank of a vehicle is introduced through a conduit into the upper portion of an absorbent layer incorporated in the cansiter so as to be adsorbed by the absorbent layer.

Such a conventional canister has adsorption characteristics such as those shown in FIG. 12. FIG. 12 shows the relationship between the L/D and the amount of fuel vapor adsorbed by the canister which was obtained by the present inventors through experiments, where L is the height of the canister, and D is the diameter thereof. As is clear from the graph, a canister arranged with $L/D > 1$ has an excellent adsorption efficiency.

However, this setting applies only to a canister which collects the fuel vapor that flows thereinto at a low flow rate, such as that vapor emanating from the fuel stored in a fuel tank or that rising from a float chamber provided in the carburetor of a vehicle. In the case of a large volume of fuel vapor which flows into the canister at a high flow rate, the above-described setting is not effective in increasing the adsorption efficiency. FIG. 13 shows the relationship between the L/D and the amount of fuel vapor absorbed which was obtained by the present inventors through experiments. In these experiments, the fuel vapor flowed into the canister at a flow rate of 30 to 40 l/min. This means that the size of the canister has to be increased in order to provide a sufficiently high adsorption efficiency. This causes a problem involving the mounting of the canister on the vehicle.

SUMMARY OF THE INVENTION

Accordingly, an object of the present invention is to provide a canister which is compact and which ensures a sufficiently good adsorption efficeincy even when a large volume fuel vapor flows thereinto at a high flow rate.

In the conventional canister, the fuel vapor adsorbed by the absorbent is removed therefrom and drawn into a suction pipe by virtue of the vacuum in the suction pipe.

In order to prevent variations in the air/fuel ratio caused at the initial stage of the removal operation by the withdrawal of air containing a high concentration of fuel vapor, such a canister includes a valve which is disposed in a conduit and which is controlled by any of various conditions of a vehicle, and a stationary orifice which controls the flow rate of the fuel vapor which is drawn into the suction pipe.

However, in the case of the large canister which adsorbs a large volume of fuel generated during a fuel filling operation, if the canister employs the above-described removal system, the valve opening conditions under which the fuel vapor is removed become strict due to high concentration of the fuel vapor, and the fuel vapor is drawn into the suction pipe only when the amount of air sucked is large. As a result, the flow rate of the fuel vapor removed falls, and the fuel vapor adsorbed by the canister cannot be removed sufficiently.

Accordingly, a second object of the present invention is to provide a fuel vapor processing apparatus which allows the air/fuel ratio affected by the fuel vapor drawn into a suction pipe from the canister to be within a predetermined allowance, and which is capable of increasing the flow rate of the fuel vapor removed by widening the range of the amount of air in which the fuel vapor adsorbed by the canister can be removed.

In order to prevent water contents from entering the canister through an air port, a rubber bose mounted on a side member of a vehicle is connected to the air port of a conventional canister. Alternatively, a tubular inlet port having a plurality of air chambers is mounted on the air inlet port. The latter is disclosed in the specification of Japanese Utility Model Laid-Open No. 56-129561.

However, an on-board canister which adsorbs a large volume of fuel vapor rising during a fuel filling operation has a large size, and can be mounted only at a lower position of the vehicle, such as in the vicinity of a fuel tank or below a floor panel. This prevents provision of any effective means for preventing water or dust entering through the air port, including the rubber hose.

Accordingly, a third object of the present invention is to provide a fuel vapor processing apparatus which is capable of preventing water contents from entering the canister so as to prevent degradation of performance of an absorbent in the canister which is caused by the water contents.

DETAILED DESCRIPTION OF THE PREFERRED EMBODIMENTS

A first embodiment of the present invention will be described below with reference to FIGS. 1 to 11.

Figure 1:
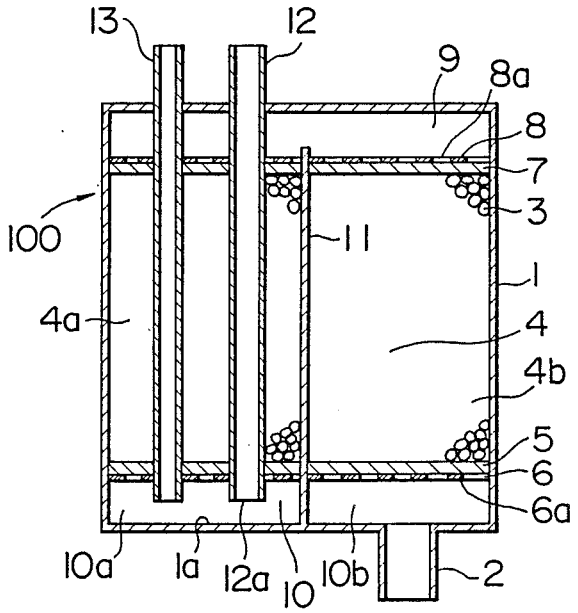
FIG. 1 is a cross-sectional view of a fuel vapor processing apparatus, showing a first embodiment of the present invention.

Referring first to FIG. 1, a casing 1 of a canister 100 is formed of a resin, and has a columnar form. A bottom surface 1*a* of the casing 1 is provided with an air port 2 which is open to the atmosphere.

The casing 1 is filled with an absorbent 3 such as activated charcoal which forms an absorbent layer 4. A filter 5 made of a non-woven fabric is provided on the lower surface of the absorbent layer 4 as viewed in FIG. 1, and a lower retaining plate 6 with perforations 6*a* formed therein is disposed on the lower surface of the filter 5. Similarly, a filter 7 made of a non-woven fabric is provided on the upper surface of the absorbent layer 4 as viewed in FIG. 1, and an upper retaining plate 8 is disposed on the upper surface of the filter 7. The filter 5, the lower retaining plate 6, the filter 7, and the upper retaining plate 8 are fixed to the inner peripheral surface of the casing 1 at certain positions.

A portion of the interior of the casing 1 which is above the absorbent layer 4 forms a first space 9, while a portion of the interior of the casing 1 which is below the absorbent layer 4 constitutes a second space 10.

A partitioning plate 11 is provided inside the casing 1 so as to divide the absorbent layer 4 into an A layer 4*a* and a B layer 4*b*. The second space 10 is also divided into two spaces 10*a* and 10*b* by the partitioning plate 11. The air port 2 communicates with the space 10*b*. The first space 9 remains undivided.

An inlet pipe 12 and a purge pipe 13 are inserted into the casing 1 through the upper portion thereof. Both the inlet pipe 12 and the purge pipe 13 pass through the first space 9 and then the first absorbent layer 4*a*, and both open into the space 10*a* of the second space 10. In order to prevent leakage of the fluid in the space 9, the inlet pipe 12 and the purge pipe 13 are fixed to the casing 1 by means of welding.

Figure 2:
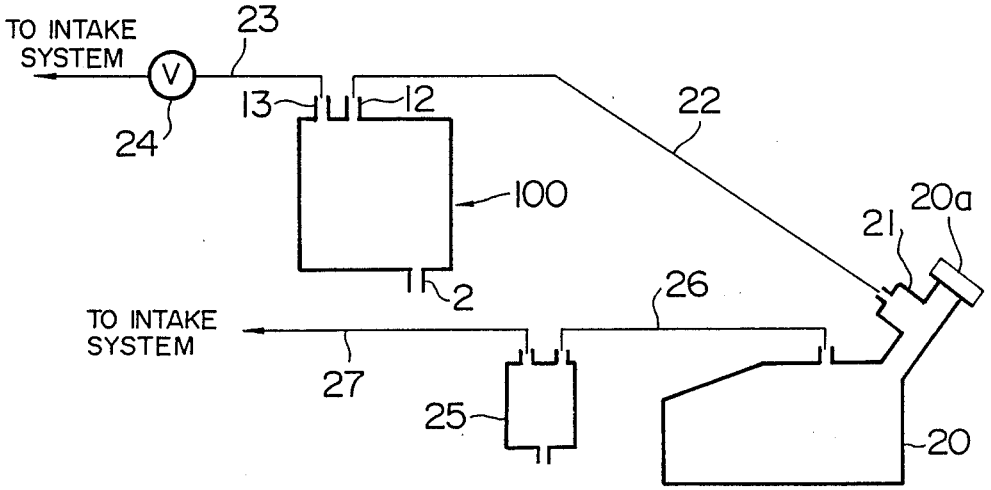
FIG. 2 shows a system in which the first embodiment is incorporated.

The thus-arranged canister 100 is connected in the manner described below with reference to FIG. 2 when it is mounted on a vehicle. The inlet pipe 12 of the canister 100 communicates with the vicinity of an inlet port 20*a* of a fuel tank 20 via a switch-over valve 21 through a tank hose 22. The switch-over valve 21 opens for a predetermined period of time during fuel filling operation, and thereby connects the fuel tank 20 to the canister 100.

The purge pipe 13 of the canister 100 is connected to a suction pipe (not shown) of an engine via a purge control valve 24 through a connection hose 23. The purge control valve 24 is adapted to adjust the amount of fuel vapor drawn from the canister 100 to the suction pipe.

The canister 100 of this embodiment is an on-board type and adsorbs only the fuel vapor generated during fuel tank filling operation. The fuel vapor generated from the fuel stored in the fuel tank 20 accumulates in a conventional canister 25. The canister 25 is connected to the fuel tank 20 by way of a tank hose 26 and to the suction pipe (not shown) by way of a connection hose 27.

Next, the operation of the present embodiment will be described.

The fuel supplied to the inlet port 20*a* of the fuel tank 20 flows into the fuel tank at a flow rate of about 30 to 40 /min. At that time, the inlet port 20*a* is sealed, and the switch-over valve 21 is opened, so as to allow the fuel vapor generated within the fuel tank 20 to flow into the inlet pipe 12 through the tank hose 22. The fuel vapor, which has passed through the inlet pipe 12, enters the space 10*a* of the second space 10 from an open end 12*a* of the inlet pipe 12. In the space 10*a*, the fuel vapor collides with the inner wall of the bottom surface 1*a* of the casing 1 which acts as a direction-changing plate, and diffuses uniformly in the space 10*a*. This reduces the flow rate of the fuel vapor. The distance between the open end 12*a* of the inlet pipe 12 and the inner wall of the bottom plate 1*a* is about 6 mm.

Subsequently, the fuel vapor passes through the perforations 6*a* of the lower retaining plate 6 and the filter 5, and flows into the A layer 4*a* of the absorbent layer 4 where it is adsorbed by the A layer 4*a* while flowing upwardly.

As stated above, since the fuel vapor flows into the A layer 4*a* of the absorbent layer 4 after having collided with the inner wall of the bottom surface 1*a* and diffused within the space 10*a*, it is adsorbed by the entirety of the A layer 4*a* of the absorbent layer 4, thereby ensuring the increased efficiency of the absorbent layer 4. If the fuel vapor flows into the absorbent layer without being slowed down, it passes through it quickly and does not accumulate therein.

Next, the fuel vapor which has leaked from the A layer 4*a* of the absorbent layer 4 enter the first space 9, diffuses therein, and then flows into the B layer 4*b* of the absorbent layer 4 where it is adsorbed while flowing downwardly. Again, the fuel vapor passes through the B layer 4*b* of the absorbent layer 4 after being diffused, and the efficiency of the absorbent layer 4 is thus increased.

When the engine is operated, a vacuum is generated in the suction pipe (not shown), and this causes evacuation of the canister 100 through the purge hose and the purge pipe 13, causing the air to be introduced into the canister 100 through the air port 2. The air introduced in this way passes through the space 10*b* of the second space 10, the B layer 4*b* of the absorbent layer 4, the first space 9, the A layer 4*a* of the absorbent layer 4, and the space 10*a* of the second space 10 in that order, and thereby removes the fuel vapor accumulated in the absorbent layer 4 The removed fuel vapor flows into the purge pipe 13, and then into the suction pipe (not shown) through the purge hose 23 via the purge control valve 24. The flow rate of the fuel vapor that flows into the suction pipe is adjusted by the purge control valve 24.

Figure 3:
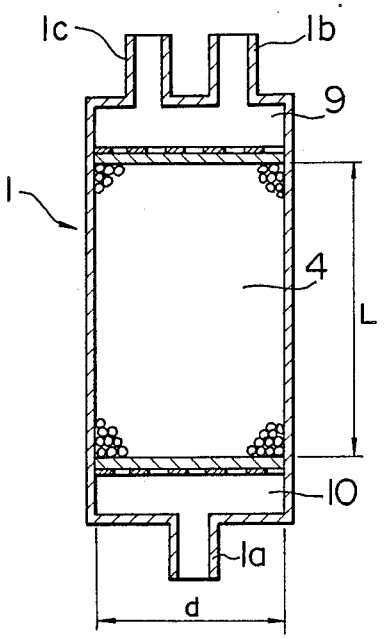
FIGS. 3 and 4 are cross-sectional views of canisters which are used in evaluations.
Figure 4:
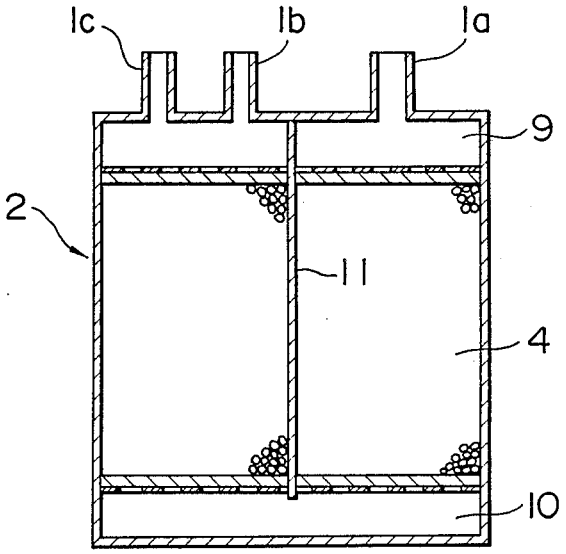

The present inventors conducted certain experiments and tests to evaluate the canister 100 of this embodiment. FIGS. 3 and 4 respectively show the comparative canisters employed in the experiments.

A canister (sample 1) shown in FIG. 3 is of the conventional type which includes a columnar casing 1 which is filled with the absorbent layer 4 in such a manner that portions of the interior of the casing 1 which are above and below the absorbent layer 4 respectively form the spaces 9 and 10. The upper surface of the casing 1 has an inlet port 1*b* and a purge port 1*c*, and the lower surface thereof has an air port 1*a*. The ratio of the height L of this canister to the diameter D thereof, L/D, is set at 1.8. The volume of the absorbent layer 4 is 4 l.

The canister shown in FIG. 4 (sample 2) is an improved version of the canister shown in FIG. 3. This canister includes a partitioning plate 11 which divides the absorbent layer into two layers 4*a* and 4*b*. The volume of the absorbent layer 4 of this canister is 3.5 l.

The absorbent layer 4 of the canister 100 shown in FIG. 1 has a volume of 3.5 l. The canisters shown in FIGS. 3 and 4 are made of the same material as that of which the canister 100 according to the present invention is composed. The absorbent employed in these canisters is the same as that in the canister 100.

The experiments were conducted in the manner described below, referring to FIG. 5. The gasoline stored in a fuel reservoir 40 was supplied by an air motor 41 into the fuel tank 20 at a rate of 30 to 38 l/min. The fuel tank 20 was connected to the canister via the switchover valve 21 which is opened only when fuel is supplied. The weight of the absorbent which adsorbed fuel vapor introduced into the canister was measured. The weight of absorbent was again measured after a predetermined amount of air had been introduced, and this weight was deducted from the first weight so as to quantify the ability of the absorbent to adsorb and remove the fuel vapor.

Figures 5, 6:
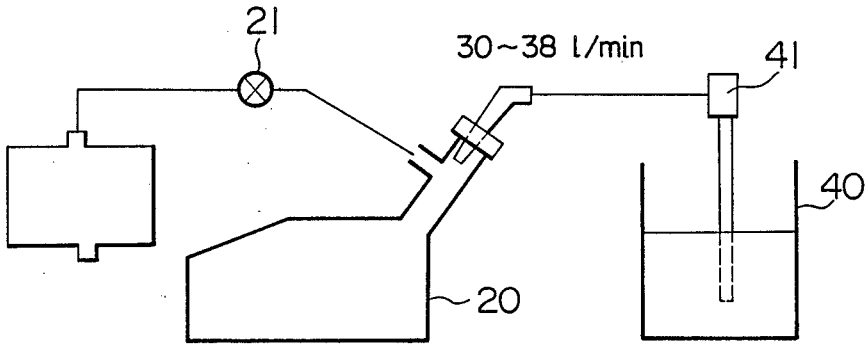
FIG. 5 illustrates the way in which the experiment was conducted.
FIG. 6 shows the result of the experiment of FIG. 5.

FIG. 6 shows the results of the experiments. As is clear from FIG. 6, the ability per liter of the activated charcoal of the present embodiment is very large when compared with those of Samples 1 and 2. This means that the absorbent of the canister of this embodiment is very efficiently.

Figure 7:
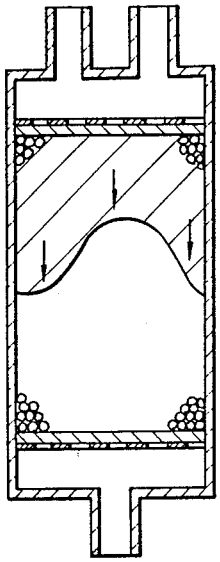
FIG. 7 illustrates the operation of the canister shown in FIG. 3.

It was also revealed by the experiments that in the canister of sample 1 the fuel vapor introduced through the inlet port 1*b* was non-uniformly adsorbed by the absorbent layer 4, that is, the speed at which the fuel vapor was adsorbed by the outer peripheral portion of the absorbent layer was high while the speed at which it was adsorbed by the central portion thereof was low, as shown in FIG. 7. It is presumed that this phenomenon occurred because the amount of fuel vapor introduced through the inlet port 1*b* was large and because the flow rate thereof was high.

Figure 8:
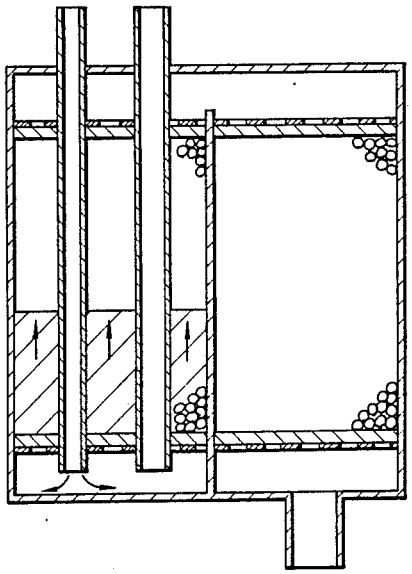
FIG. 8 illustrates the operation of the canister according to the present invention.

In contrast, in the canister 100 of this embodiment, since the fuel vapor introduced through the inlet pipe collides with the inner wall of the bottom surface 1*a* and diffuses within the space 10*a* in the second space 10 before being absorbed by the absorbent layer 4, the adsorption progresses substantially uniformly, as shown in FIG. 8, thus ensuring an increase in the efficiency of the absorbent layer 4.

Thus, in the present invention, it is possible to provide adequate adsorption efficiency without increasing the size of the canister even when a large quantity of fuel vapor flows into the canister at high speed.

Figure 9:
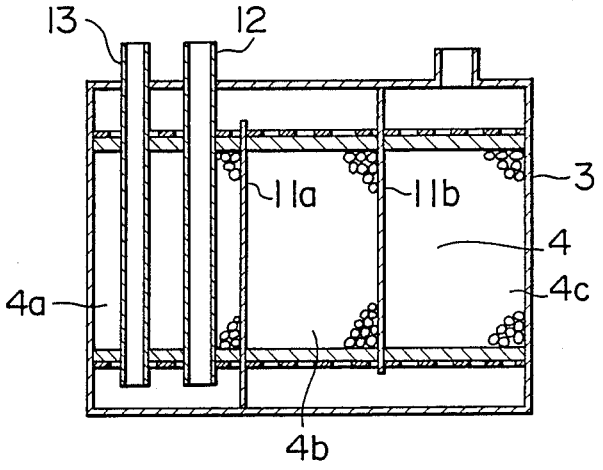
FIGS. 9 through 11 show modified examples of a canister of FIG. 1.
Figure 10:
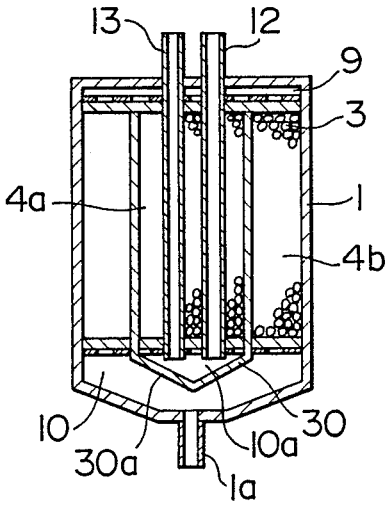
Figure 11:
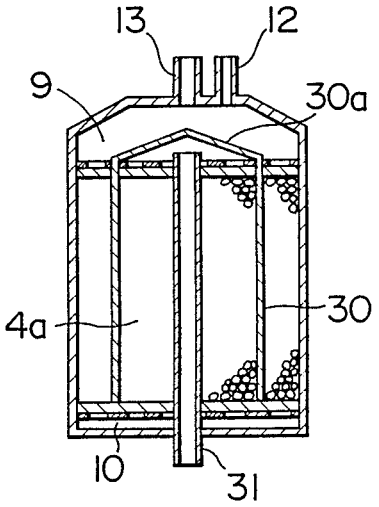
Figure 12:
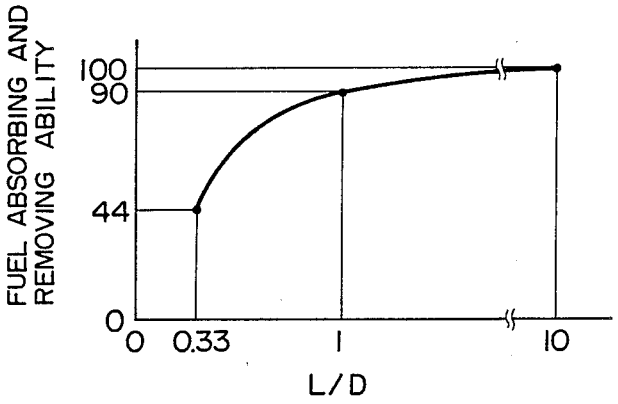
FIG. 12 PRIOR ART
FIGS. 12 and 13 show the adsorption characteristics of a conventional canister.
Figure 13:
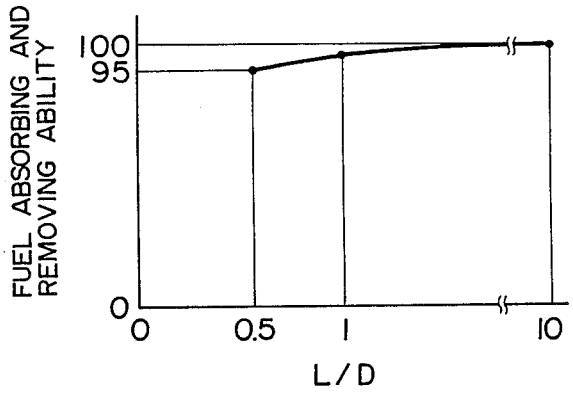
FIG. 13 PRIOR ART

The present invention is not limited to the aforementioned embodiment, and various modifications and alternations may be made without departing from the spirit and scope of the invention. FIGS. 9 through 11 show such modifications.

In the example shown in FIG. 9, the absorbent layer 4 is divided into three parts by partitioning plates 11*a* and 11*b* in order to further increase the adsorption efficiency.

In the example shown in FIG. 10, the absorbent layer 4 is divided into a central layer 4*a* and a peripheral layer 4*b*. The inlet pipe 12 and the purge pipe 13 pass through the central layer 4*a*, and open into the space 10*a* in the second space 10. The fuel vapor introduced through the inlet pipe 12 collides with a bottom surface 30*a* of an inner casing 30 that forms the space 10*a*, diffuses within the space 10*a*, and then flows into the central layer 4*a* and the peripheral layer 4*b* where it is adsorbed.

In the example shown in FIG. 11, the absorbent layer 4 is divided into the central layer 4*a* and the peripheral layer 4*b*. An air pipe 31 passes through the central layer 4*a*, and opens into a space 9*b* of the space 9. The fuel vapor introduced through the inlet pipe 12 collides with an upper surface 30*a* of the inner casing 30, diffuses within the space 9, and is then adsorbed by the peripheral layer 4*b* and the central layer 4*a* in that order.

A second embodiment of the present invention will now described with reference to FIG. 14.

A canister 200 includes a columnar outer casing 202 which is made of a resin or an iron plate, and a columnar inner casing 203 which is also made of a resin or an iron plate and which is disposed within the outer casing 202.

An absorbent 206 which may be activated charcoal is charged between the outer casing 202 and the inner casing 203 so as to form an absorbent layer 205. A filter 220 which is made of a non-woven fabric is disposed on the lower surface of the absorbent layer 205 as viewed in FIG. 14 and a bottomed surface portion 230 with perforation 230*a* formed therein is provided on the lower surface of the filter 220. Similarly, a filter 217 which is made of a non-woven fabric is disposed on the upper surface of the absorbent layer 205, and an upper retaining plate 214 with perforations 214*a* formed therein is provided on the upper surface of the filter 217. The filter 220, the bottomed surface portion 230 of the inner casing 203, the filter 217, and the upper retaining plate 214 are fixed to the inner peripheral surface of the outer casing 202 at certain positions.

The absorbent 206 is also charged in the inner casing 203 so as to form an absorbent layer 204. A filter 219 and a lower retaining plate 216 with perforations 216*a* formed therein are disposed on the lower surface of the absorbent layer 204 as viewed in FIG. 14, and a filter 218 and an upper retaining plate 215 with perforations 215*a* formed therein are provided above the absorbent layer 204 as viewed in FIG. 14. No perforations 215*a* are formed in a portion of the upper retaining plate 215 which faces a second inlet port 245. A portion of the interior of the inner casing 203 which is located below the absorbent layer 204 forms a first space 207. A portion of the interior of the outer casing 202 which is located above the absorbent layer 205 forms a second space 208, and a portion of the interior of the outer casing 202 which is located below the absorbent layer 205 forms a third space 209.

Figure 14:
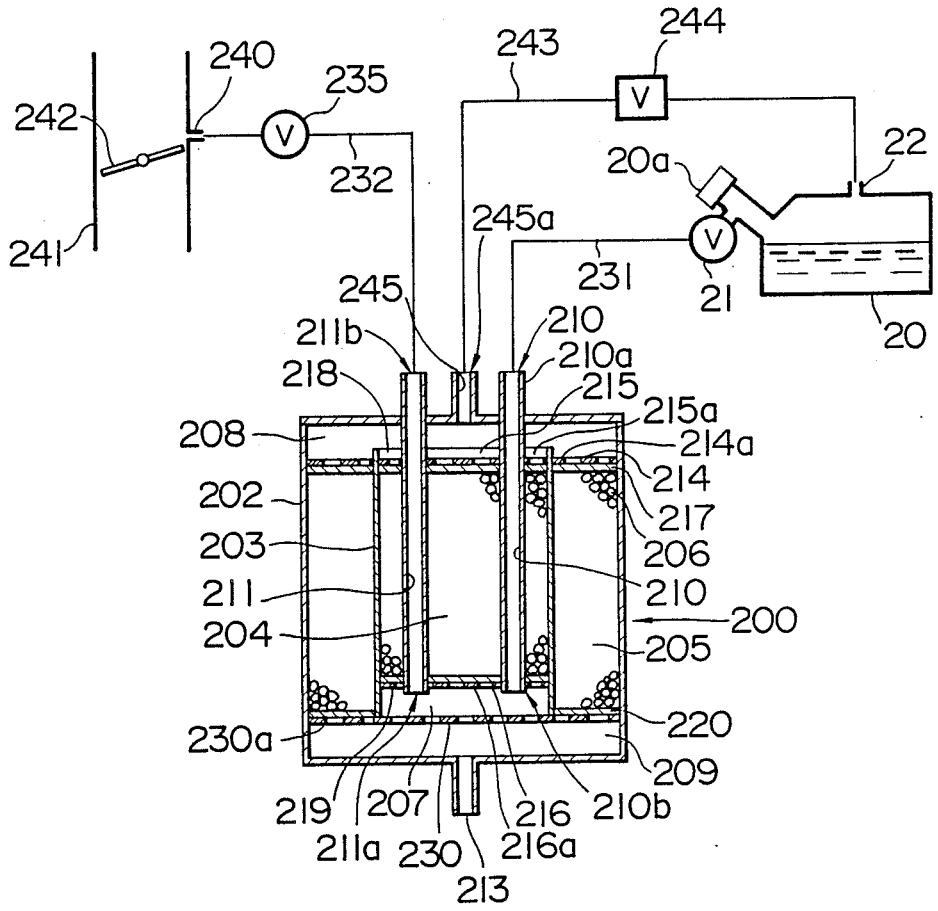
FIG. 14 is a cross-sectional view of a canister, showing a second embodiment of the present invention.

A first inlet pipe 210 and a purge pipe 211 are inserted into the outer casing 201 through the upper surface thereof as viewed in FIG. 14, and a second inlet port 245 is formed in the upper surface of the outer casing 202. One end 210*a* of the inlet pipe 210 is connected to the fuel supply pipe 20*a* of the fuel tank 20 through a conduit 231, and the other end 210*b* thereof passes through the second space 208 and the absorbent layer 204, and opens into the first space 207. The second inlet port 245 opens into the second space 208, and one end 245*a* thereof is connected to a port 22 formed in the upper surface of the fuel tank 20 through a conduit 243. One end 211*a* of the purge pipe 211 passes through the second space 208 and the absorbent layer 204, and opens into the first space 207, and the other end 211*b* is connected through a conduit 232 to a port 240 for a throttle valve 242 which is formed in a suction pipe 241. A control valve 244 which opens when the pressure in the fuel tank 20 reaches a predetermined value is provided in the conduit 243, and a control valve 235 for controlling the amount of fuel vapor which flows into the suction pipe 240 is disposed in the conduit 232.

The lower surface of the outer casing 202 as viewed in FIG. 14 is provided with an air port 213 which opens to the atmosphere.

Next, the operation of the second embodiment will be described below.

When the pressure of the fuel vapor generated in the fuel tank 20 while the engine is being operated or the engine operation is stopped reaches a predetermined value at which the control valve 244 is opened, it is introduced into the canister 200 through the second inlet port 245 by way of the conduit 243.

The fuel vapor introduced through the second inlet port 245 collides with the non-perforated portion of the upper retaining plate 215, diffuses within the second space 208, and is adsorbed by the absorbent layers 204 and 205.

The fuel supplied to the fuel supply pipe 20*a* of the fuel tank 20 flows into the fuel tank 20 at a flow rate of about 30 to 40 l/min. At this time, the switch-over valve 21 is opened, and the fuel vapor generated during fuel filling operation is thereby introduced into the canister 200 through the first inlet pipe 210.

The fuel vapor introduced through the first inlet pipe 210 is discharged into the first space 207 from the open end 210*b* of the inlet pipe 210. The discharged fuel vapor collides with the inner wall of the bottom surface portion 230 of the inner casing 203 which acts as a direction-changing plate, and diffuses in the space 207 uniformly. This results in the reduction of the flow rate thereof. The distance between the open end 210*b* of the first inlet pipe 210 and the inner wall of the bottom surface portion 230 is set at about 6 mm.

Subsequently, the fuel vapor flows into the absorbent layer 204 through the perforation 216*a* of the lower retaining plate 216 and the filter 219 where it is adsorbed by the adsorbent layer 204 while flowing upwardly.

As stated above, since the fuel vapor flows into the adsorbent layer 204 after having collided with the inner wall of the bottom surface portion 230 and diffused in the first space 207, it is adsorbed by the entirety of the absorbent layer 204, thereby ensuring the increased adsorption efficiency of the absorbent layer 204. If the fuel layer flows through the absorbent layer at high speed, it passes through it and does not accumulate therein.

Next, the fuel vapor which has leaked from the absorbent layer 204 enters the second space 208, diffuses therein, and then flows into the absorbent layer 205 where it is adsorbed while flowing downwardly. Again, the fuel vapor flows into the absorbent layer 205 after being diffused in the space 208, and the efficiency of the absorbent layer 205 is thus increased.

When the engine is operated, the control valve 235 opens in response to the running state of the vehicle. This causes the vacuum generated in the suction pipe 241 to act on the canister 200 through the conduit 232 and the purge pipe 211, causing the air to be introduced from the air port 213. The air passes through the third space 209, the absorbent layer 205, the second space 208, the absorbent layer 204 and the first space 207 in that order, and causes the fuel vapors mainly adsorbed by the adsorbent layer 204 to be drawn into the suction pipe 241 through the purge pipe 211.

Figure 15:
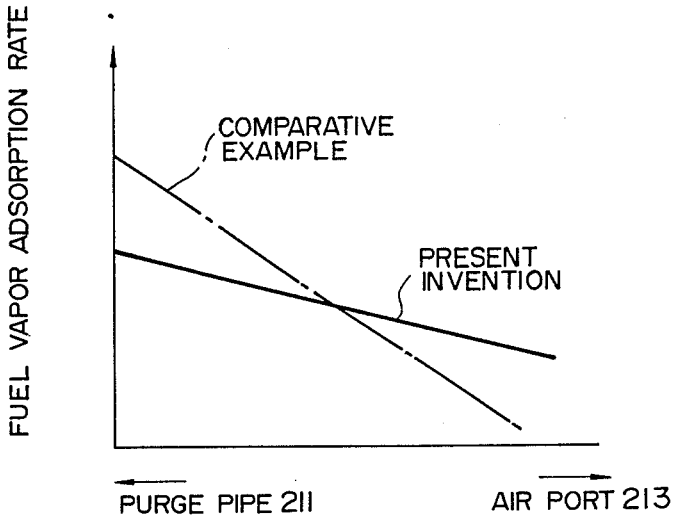
FIG. 15 shows the fuel vapor adsorption rate of the canister of FIG. 14.

This embodiment employs one canister to adsorb both the large volume (100 g/min) of fuel vapor generated in a short period of time during a fuel filling operation and the small volume (20 to 25 g/h) thereof gradually generated by the stored fuel in a predetermined period. Moreover, in this embodiment, the fuel vapor generated during the fuel filling operation is introduced into the first space 207 through the first inlet pipe 210 so it is mainly adsorbed by the absorbent layer 204, whereas fuel vapor emanating from the stored fuel is adsorbed by both of the absorbent layers 204 and 205 by being introduced into the second space 208 through the second inlet port 245. As a result, distribution of the fuel vapor adsorption rate of absorbent layers 204 and 205 can be made uniform as compared with a case where the two types of fuel vapors are introduced through the first inlet pipe 210. FIG. 15 is a graph showing the fuel vapor adsorption rate of the absorbent layer 204 which has adsorbed fuel vapor in experiments. The axis of abscissa of the graph denotes the absorbent layer 204 with the leftward portion representing the portion of the layer 204 which is closes to the purge pipe 211 (the upper portion thereof as viewed in FIG. 14), and the rightward portion of the axis of abscissa representing the portion of the layer 204 closer to the air port 213 (the lower portion thereof as viewed in FIG. 14). The comparative example denotes the adsorption rate obtained when the two types of fuel vapors are introduced through the first inlet pipe 210. As can be seen from FIG. 15 the present embodiment ensures uniform distribution of the adsorption rate of the absorbent layer 204. This allows a reduction in the concentration of the fuel vapor that is mainly removed from the absorbent layer 204 at the initial stage of removal, preventing occurrence of variations in the air/fuel ratio due to the air containing a high concentration of fuel vapor which is drawn out at the initial stage of removal.

Next, a third embodiment of the present invention will be described with reference to FIG. 16.

A canister 300 includes an outer casing 302 and an inner casing 303, as is the case of the second embodiment shown in FIG. 14. It has a first space 307, a second space 308 and a third space 309, and contains an absorbent layer 305, an absorbent layer 304, a filter 320, a filter 317, an upper retaining plate 314, a filter 319, a lower retaining plate 316, a filter 318, and an upper retaining plate 315.

An inlet pipe 310 is inserted into the outer casing 302 from the upper surface thereof. One end 310*a* of the inlet pipe 310 is connected to the fuel supply pipe 20*a* of the fuel tank 20 through a conduit 331, and the other end 310*b* thereof passes through the second space 308 and the absorbent layer 304, and opens into the first space 307. Purge pipes 311 and 312 are also inserted into the outer casing 302. One end 311*a* of the purge pipe 311 passes through the absorbent layer 304, and opens to the first space 307. One end 312*a* of the purge pipe 312 is connected through a conduit 332 to port 340 provided in a suction pipe 341 at the downstream side of a throttle valve 342.

A control valve 335 for controlling the flow rate of the fuel vapor which is drawn into the suction pipe 340 is provided in a space 333 formed between the purge pipes 311 and 312. The control valve 335 consists of a solenoid 336, and a valve body 337 which is attracted to the solenoid 336 when the solenoid is energized so as to causes the purge pipes 311 and 312 to communicate with each other. The outer periphery of the solenoid 336 is surrounded by a radiator plate 338 formed from a material having a high thermal conductivity such as Al or Cu. The radiator plate 338 extends into the absorbent layer 304.

Figure 16:
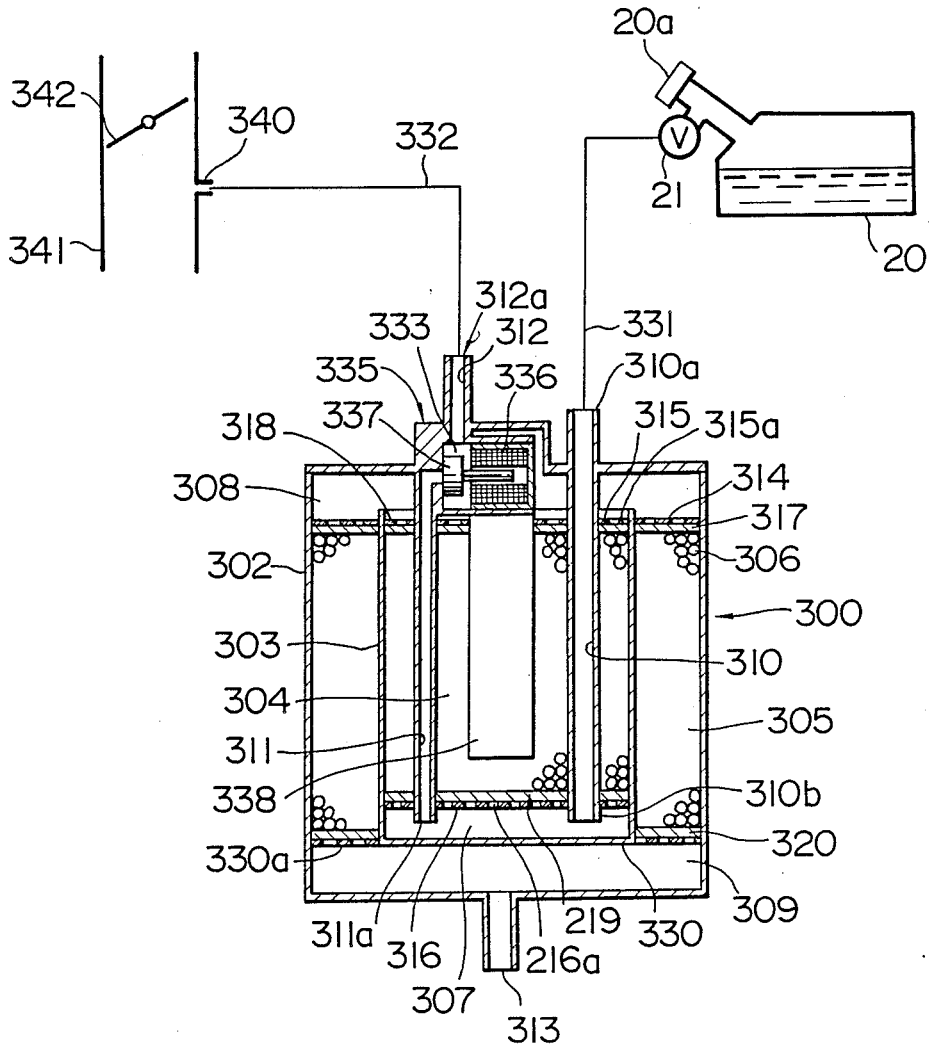
FIG. 16 is a cross-sectional view of a canister, showing a third embodiment of the present invention.

The lower surface of the outer casing 302 as viewed in FIG. 16 is provided with an air port 313 which is open to the atmosphere.

Next, the operation of the third embodiment will be described below.

The fuel vapor introduced into the canister through the inlet pipe 310 is discharged into the first space 307 from open end 310*b* of the inlet pipe 310. The discharged fuel vapor collides with the inner wall of a bottom surface portion 330 of the inner casing 303 which acts as a direction-changing plate, and diffuses uniformly in the space 307. This reduces the flow rate of the fuel vapor.

Thereafter, the fuel vapor passes through the lower retaining plate 316 and the filter 319, and then flows through the absorbent layer 304 upwardly during which it is absorbed by the absorbent layer 304.

The fuel vapor which leaks out from the absorbent layer 304 diffuses in the second space 308, and is then absorbed by the absorbent layer 305.

When the engine is operated, the solenoid 336 of the control valve 335 is energized in accordance with the running state of the vehicle so as to attract the valve body 337 toward it and thereby cause the purge pipes 311 and 312 to communicate with each other. This causes the vacuum generated in the suction pipe 341 to act on the canister 300 through the conduit 332 and the purge pipes 311 and 312, causing the air to be introduced through the air port 313. The air passes through the third space 309, the absorbent layer 305, the second space 308, the absorbent layer 304, and the first space 307 in that order, and thereby causes the fuel vapor absorbed mainly by the absorbent layer 304 to be drawn into the suction pipe 341 through the purge pipes 311 and 312.

At this time, the radiator plate 338 surrounding the outer periphery of the solenoid 336 of the control valve 335 is gradually heated by the heating of the solenoid 336 which occurs when it is energized. This causes the portion of the absorbent layer 304 located close to the radiator plate 338 to be heated during withdrawal of fuel vapor.

In the case where the fuel vapor collected by the canister is removed therefrom, the concentration of the fuel vapor drawn at the initial stage of removal operation is very high. It rapidly decreases as the time elapses, varying the air-fuel ratio to a large extent. However, in this embodiment, since the radiator plate 338 is gradually heated by the solenoid 336 after the removal operation has been started, removal of the fuel vapor adsorbed by the absorbent layer 304 becomes positive as the time elaspses, preventing rapid change in the air-fuel ratio.

Figure 17:
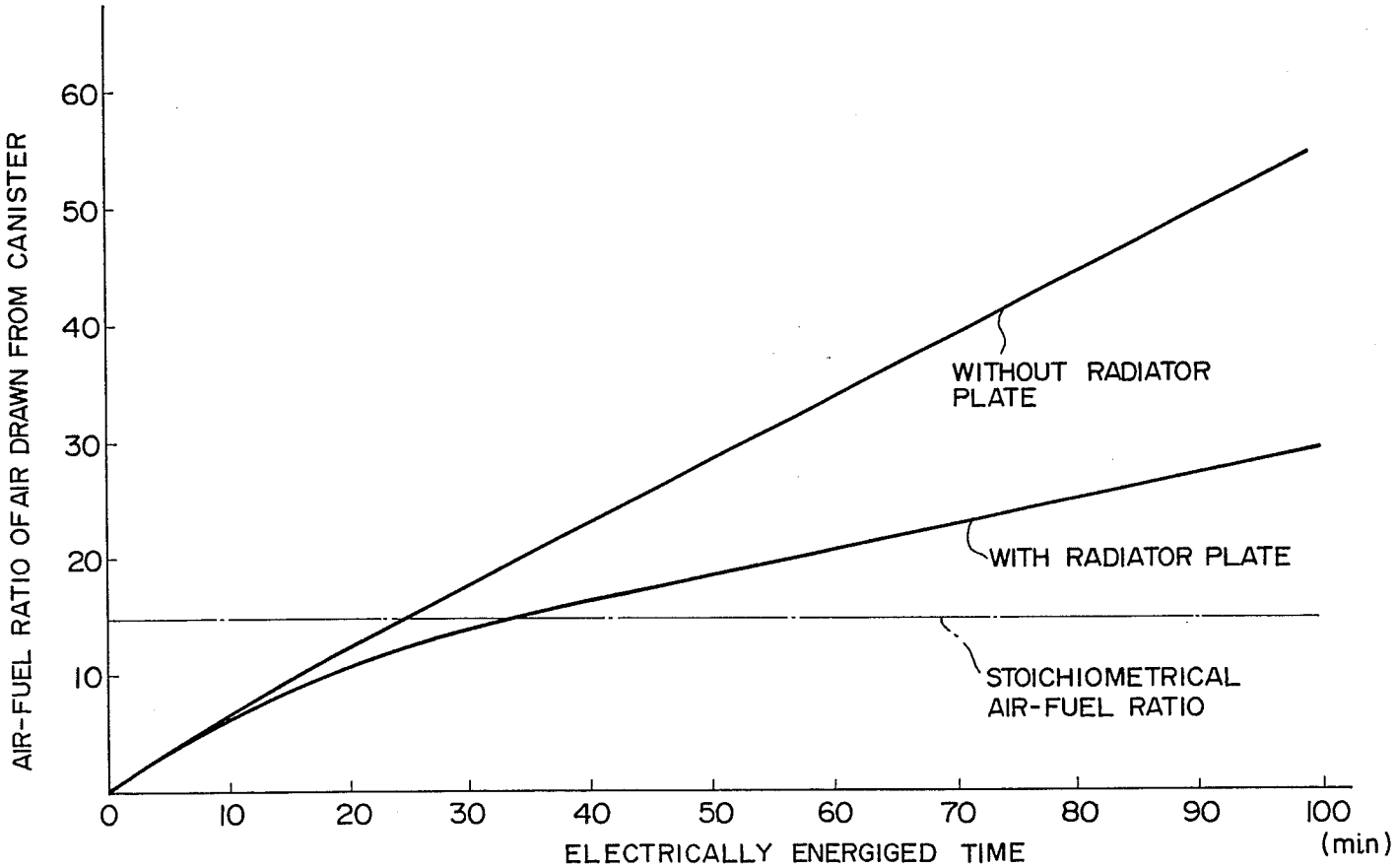
FIG. 17 shows the relationship between the time in which a solenoid is energized and the air/fuel ratio of the air drawn from the canister.

FIG. 17 shows the relationship between the time and the air-fuel ratio A/F of the air that has passed through the canister which has accumulated the fuel vapor at a rate of 10 l/min at a temperature of 20° to 21° C. As is clear from FIG. 17, rapid change in the air-fuel ratio can be avoided by the provision of the radiator plate, and control of the air-fuel ratio can be thereby made easily.

Figure 18:
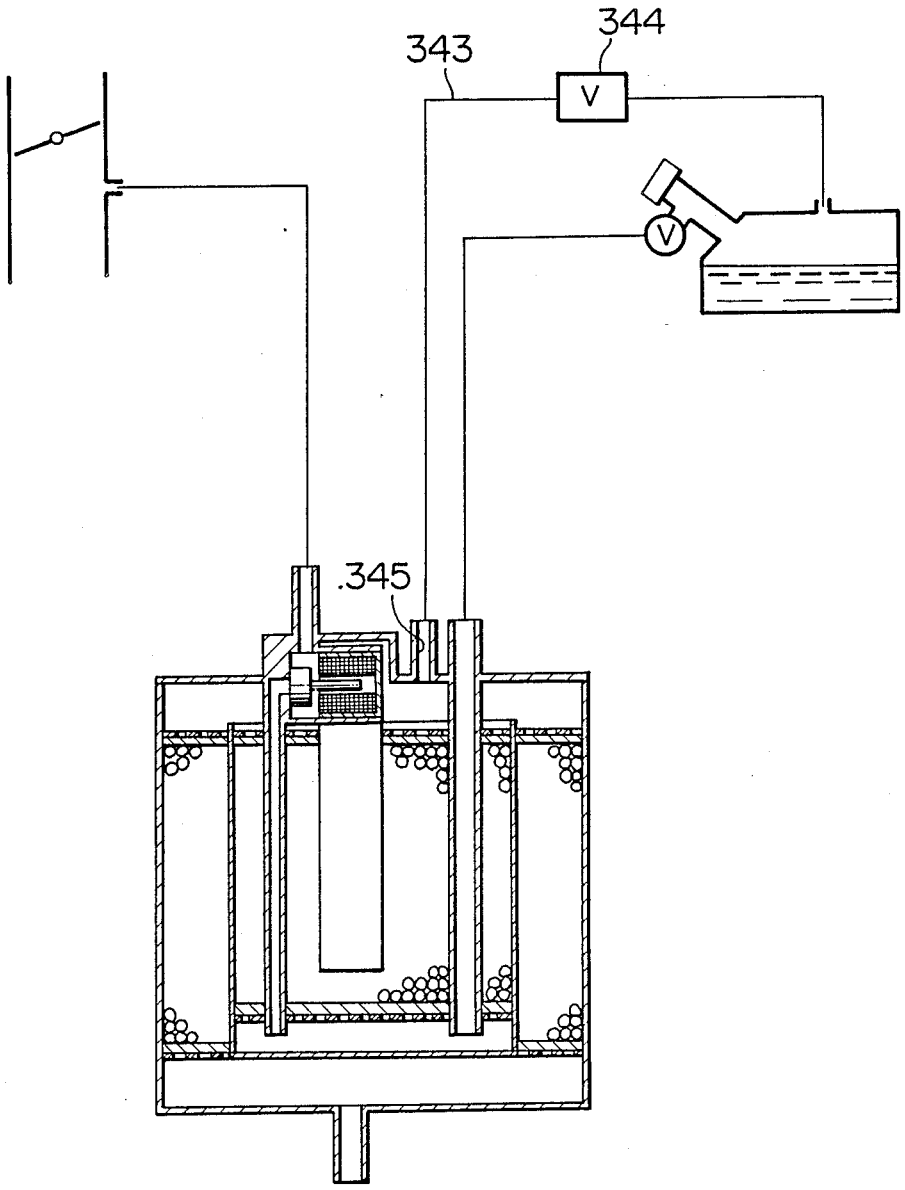
FIG. 18 shows a modified example of the canister of FIG. 16.

This embodiment effectively utilizes heating of the solenoid 336 of the control valve 335 for controlling the flow rate of the fuel vapor that flows into the suction pipe 341, so there is no increase in the power consumption. It is preferable for the radiator plate 338 to be extended throughout the absorbent layer 304 in order to improve the fuel vapor removal efficiency. Further, a small volume of fuel vapor emanating from the fuel stored in the fuel tank 20 may also be introduced into the canister 300 via a control valve 344 through a conduit 343 and a second inlet port 345 formed in the outer casing 302 shown in FIG. 18.

Next, a fourth embodiment of the present invention will be described below with reference to FIG. 19.

A canister 400 includes an outer casing 402, and an inner casing 304, as in the case of the canister shown in FIG. 14. The canister 400 has a first space 407, a second space 408, and a third space 409 in it. It contains an absorbent layer 405, an absorbent layer 404, a filter 420, a filter 417, an upper retaining plate 414, a filter 419, a lower retaining plate 416, a filter 418, and an upper retaining plate 415.

Figure 19:
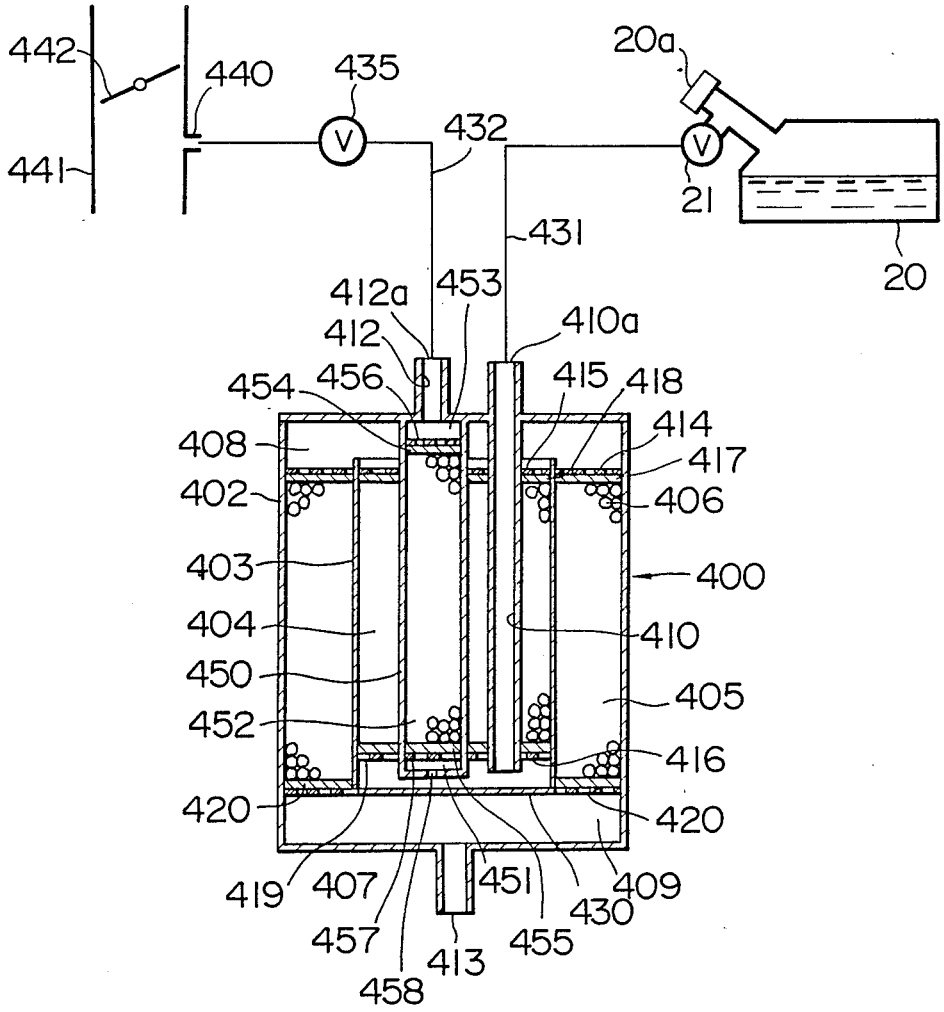
FIG. 19 is a cross-sectional view of a canister, showing a fourth embodiment of the present invention.

An inlet pipe 410 is inserted into the canister 400 through the upper surface of the outer casing 402 as viewed in FIG. 19. One end 410*a* of the inlet pipe 410 is connected to the fuel supply pipe 20*a* of the fuel tank 20 through a conduit 431, and the other end 410*b* thereof passes through the second space 408 and the absorbent layer 404, and opens to the first space 407. A purge port 412 is formed in the outer casing 402, and in internal casing 450 which forms a space that communicates with the purge port 412 is provided in the inner casing. The internal casing 450 passes through the second space 408 and the absorbent layer 404. It has a fourth space 451, an absorbent layer 452, and a fifth space 453, and incorporates a filters 454 and 455, an upper retaining plate 456, and a lower retaining plate 457. The fourth space 451 communicates with the first space 407 through perforations 458. The purge port 412 which communicates with the fifth space 453 is connected at one end thereof 412*a* to a port 440 in a suction pipe 441 which is located downstream a throttle valve 442 through a conduit 432. A control 435 for controlling the flow rate of the fuel vapor which is drawn into the suction pipe 441 is provided in the conduit 432.

The lower surface of the outer casing 402 is viewed in FIG. 19 is provided with an air port 413 which is open to the atmosphere.

Next, the operation of the fourth embodiment will be described.

The fuel vapor introducted through the inlet pipe 410 is discharged into the first space 407 from the open end 410*b* thereof. The discharged fuel vapor collides with the inner wall of a bottom surface portion 430 of the inner casing 403 which serves as a direction-changing plate, and diffuses uniformly in the space 407. This results in a reduction in the flow rate thereof.

Thereafter, the fuel vapor passes through the lower retaining plate 415 and the filter 419, and then flows into the absorbent layer 404 where it is adsorbed while flowing upwardly.

At this time, a part of the fuel vapor diffused in the space 407 flows into the fourth space 451 through perforations 458, and is adsorbed by the absorbent layer 452. However, a large part thereof flows into the absorbent layer 404.

The fuel vapor which leaks from the absorbent layer 404 into the second space 408 diffuses therein, and is then adsorbed by the absorbent layer 405.

When the engine is operated, the control valve 435 is opened in accordance with the running state of the vehicle. This causes the vacuum generated in the suction pipe 441 to act on the canister 400 through the port 440 and the purge port 412, causing the fuel vapor accumulated mainly in the absorbent layers 404 and 405 as well as the air from the air port 413 to be drawn into the suction pipe 441.

The fuel vapor which is to be drawn into the suction pipe 441 passes through the perforations 458 and then flows through the absorbent layer 452. At that time, part of the fuel vapor removed from the absorbent layers 404 and 405 is adsorbed by the absorbent layer for a certain period of time at the initial stage of removal operation due to small adsorption rate of the absorbent layer 452 (sufficient ability of adsorption thereof). As the adsorption rate of the absorbent layer 452 increases, the amount of fuel vapor adsorbed by the absorbent layer 452 decreases, thereby gradually increasing the amount of fuel vapor drawn into the suction pipe. As a result, variations in the air-fuel ratio which are caused by the air containing a high concentration of fuel vapor drawn at the initial stage of the removal operation can be prevented. If the absorbent layer 452 is very efficient, the volume of the fuel vapor drawn into the suction pipe decreases. Therefore, an absorbent which adsorbs the fuel vapor less than that for the absorbent layers 404 and 405 and which removes it well is used as the material for the absorbent layer 452 (an activated charcoal made of coal having thinner holes may be used as the material for the absorbent layer 452, if an activated charcoal made of coconut shell is used as that for the absorbent layers 404 and 405).

Figure 20:
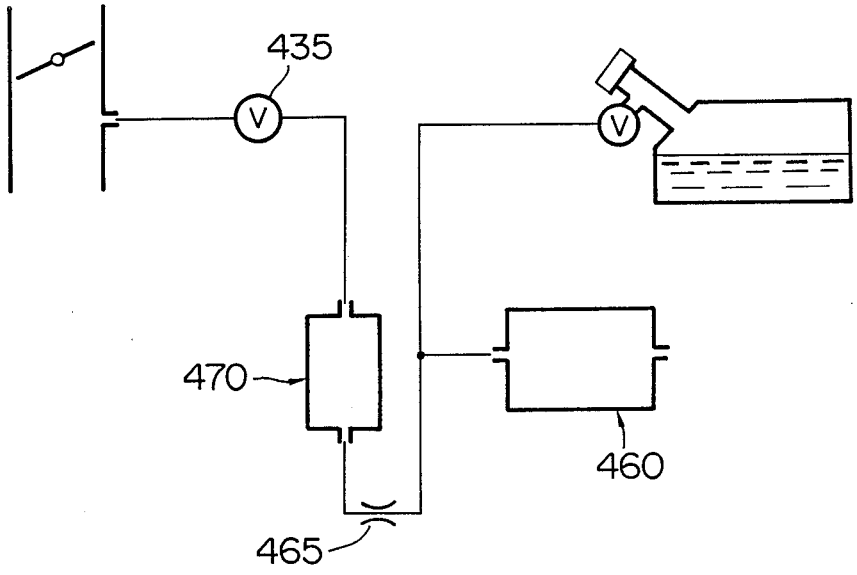
FIGS. 20 and 21 show modified examples of the canister of FIG. 19.

The canister 400 may include a sub canister 470 containing the absorbent layer 452 and a main canister 460 containing the absorbent layers 404 and 405, the sub canister 470 and the main canister 460 being connected with a throttle valve 465 therebetween, as shown in FIG. 20. In that case, the same type of absorbent is used as those for the absorbent layers 452, 404, and 405 if the main canister 460 is installed in the atmosphere of a lower temperature while the sub canister 470 is placed in the atmosphere of a higher temperature.

Figure 21:
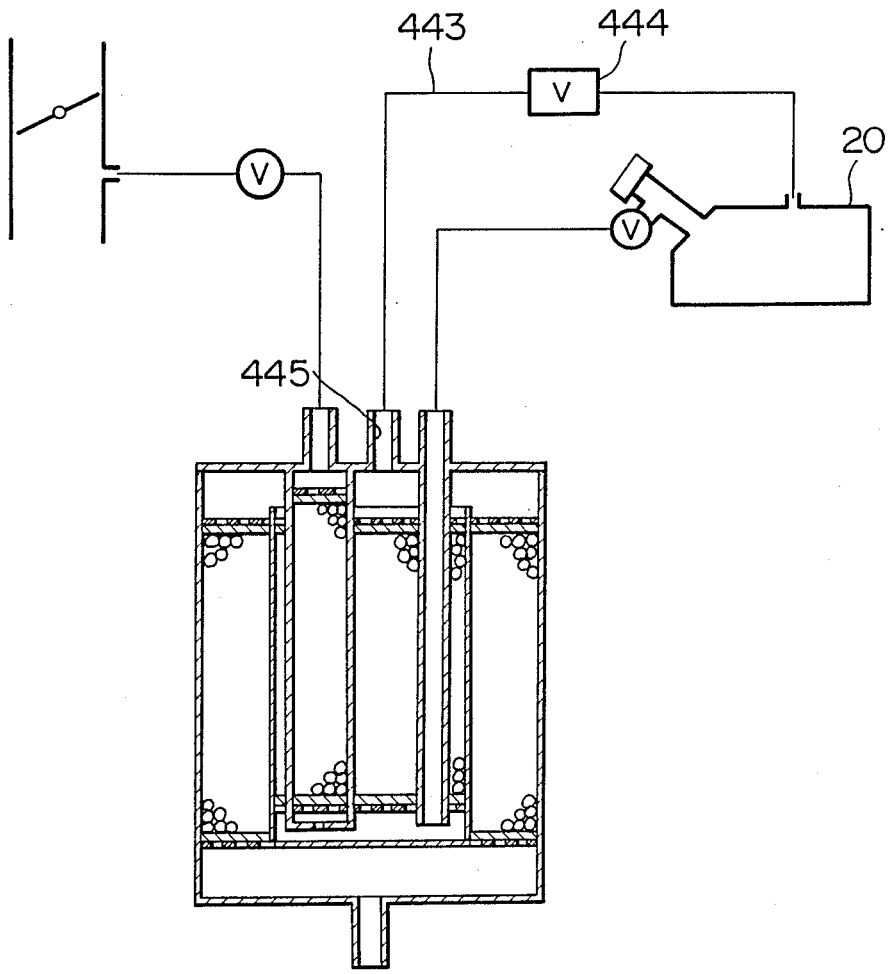

A small volume of fuel vapor generated from the fuel stored in the fuel tank 20 may also be introduced into the canister 400 via a control valve 444 through a conduit 443 and a second inlet port 445 formed in the outer casing 302, as shown in FIG. 21.

Next, a fifth embodiment of the present invention will be described below with reference to FIG. 22.

A canister 500 includes a columnar casing 501 which is formed of a resin or an iron plate. An absorbent layer 503 which may be of activated charcoal is filled in the casing 501 so as to form an absorbent layer 504.

A partitioning plate 511 is provided within the casing 501 so as to divide the absorbent layer 504 into an A layer 504*a* and a B layer 504*b* in such a manner that the ratio of the amount of absorbent in the A layer 504*a* to that in the B layer 504*b* is set at 1.5 to 2.5:1.

Figure 22:
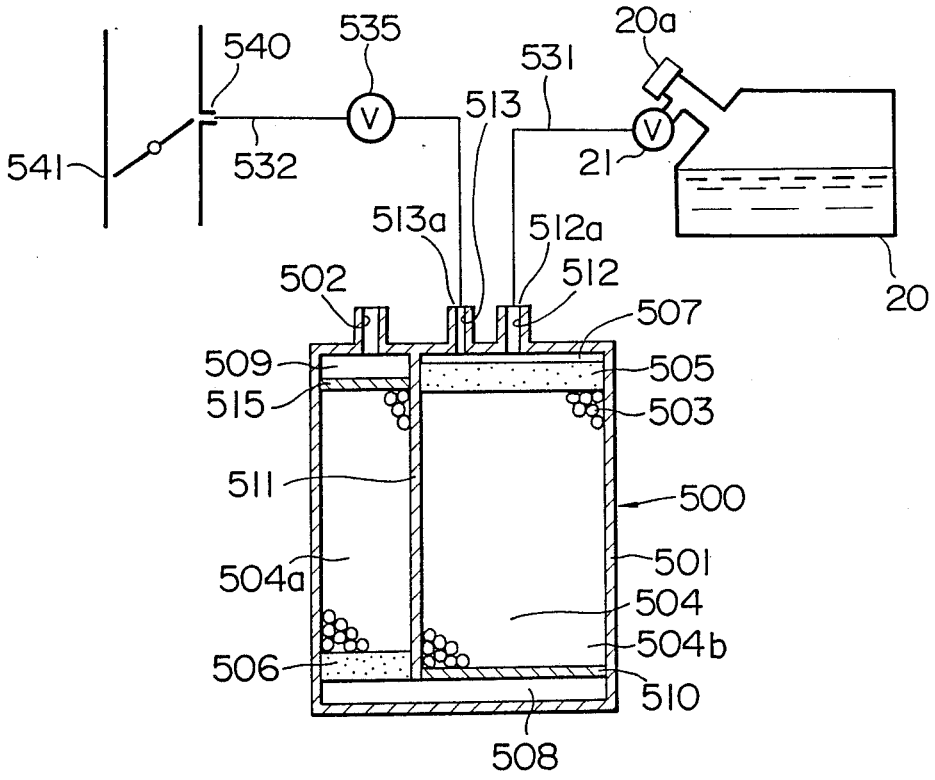
FIG. 22 is a cross-sectional view of a canister, showing a fifth embodiment of the present invention.

A filter 515 is provided on the upper surface of the absorbent layer 504*a* as viewed in FIG. 22, and a perforated diffusing member 506 which acts as a direction-changing plate is disposed on the lower surface of the absorbent layer 504*a* as viewed in FIG. 22. A perforated diffusing member 505 is disposed on the upper surface of the absorbent layer 504*b* as viewed in FIG. 22, and a filter 510 is provided on the lower surface of the absorbent layer 504*b*.

A portion of the interior of the casing 501 which is located above the perforated diffusing member 505 forms a first space 507. A portion of the interior of the casing 501 which is located below the filter 510 and the perforated diffusing member 506 forms a second space 508, and a portion of the interior of the casing 501 located above the filter 514 forms a third space 509.

The upper surface of the casing 501 is provided with a first inlet port 512 and a purge port 513 which communicate with the first space 507, as well as an air port 502 which is open to the atmosphere. One end 512*a* of the inlet port 512 is connected to a fuel supply pipe 20*a* of the fuel tank 20 through a conduit 531, and one end 513*a* of the purge port 513 is connected to a suction pipe 514 through a conduit 532. The switch-over valve 21 which is opened only during the fuel filling operation is provided in the conduit 531, and a control valve 535 for controlling the flow rate of the fuel vapor which is drawn into the suction pipe 541 is disposed in the conduit 532.

Next, the operation of the fifth embodiment will be described.

The fuel vapor emanating from the fuel tank 20 during the fuel filling operation is introduced into the first space 507 in the canister 500 through the conduit 531 and the inlet port 512. The introduced fuel vapor is diffused by the perforated diffusing member 505 which acts as a direction-changing plate, and is then adsorbed uniformly by the absorbing material layer 504*b*. The fuel vapor which leaks from the absorbent layer 504*b* enters the second space 508, diffuses therein, and is adsorbed by the absorbent layer 504*a*.

When the engine is operated, the control valve 535 is opened in accordance with the running state of the vehicle. This causes the vacuum generated in the suction pipe 541 to act on the canister 500 through the port 540 and the purge port 513, causing the fuel vapor accumulated in the absorbent layer 504 as well as the air introduced through the air port 502 to be drawn into the suction pipe 541.

Figure 23:
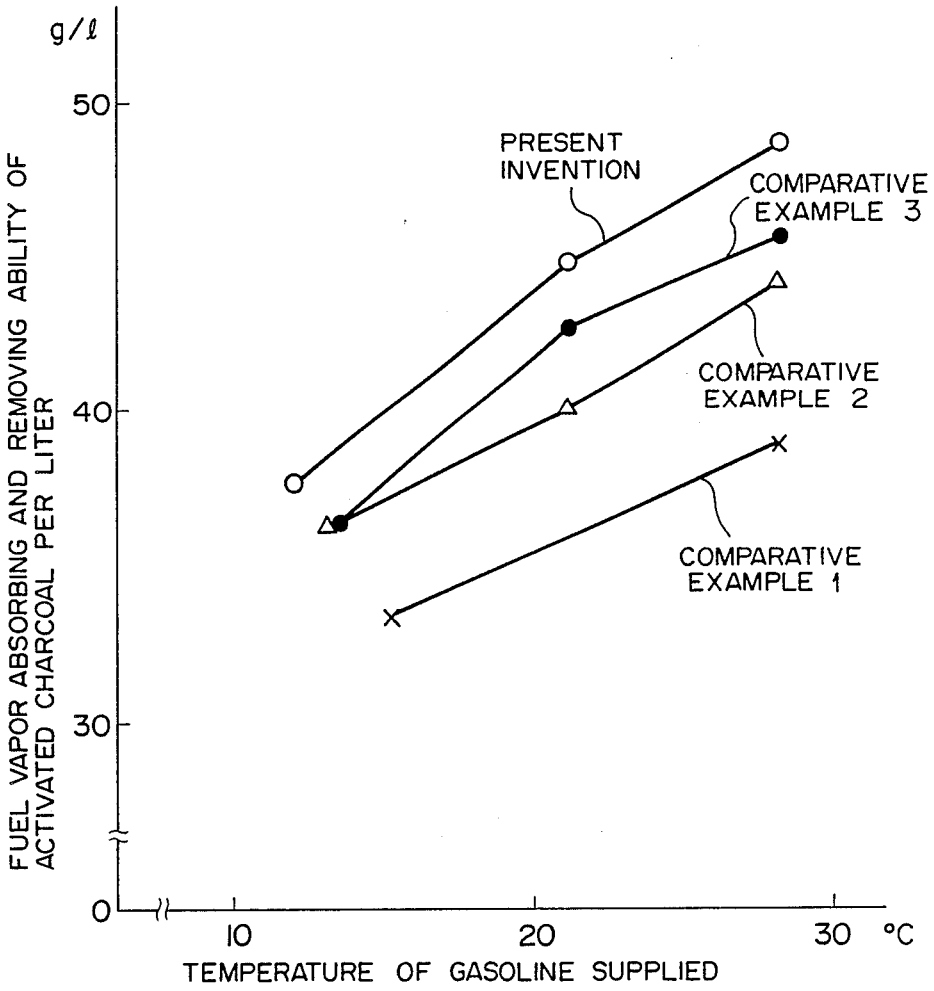
FIG. 23 shows the adsorption characteristics of the canister of FIG. 22.

As stated above, since the absorbent material layer 504 is divided into the A layer 504*a* and the B layer 504*b* by the partitioning plate 511 in such a manner that the ratio of the amount of absorbent in the B layer 504*b* to that in the A layer 504*a* is 1.5 to 2.5:1, the adsorption efficiency of the absorbent layer 504 is further increased. The present inventors examined through experiments the ability with which the absorbent layer 504 of the canister 500 adsorbs fuel vapor, and FIG. 23 shows the relationship between the ability of the absorbent with which the absorbent layer adsorbs and removes the fuel vapor and the temperature of the supplied fuel. The ability of the absorbent is represented by the weight of the fuel vapor which has been removed from the absorbent layer, and this weight was obtained by measuring the weight of the absorbent layer which has adsorbed the fuel vapor generated from the fuel supplied into the fuel tank 20 at a flow rate of 30 to 38 l/min and then by deducing from this weight the weight of the absorbent layer which was measured after a predetermined amount of air has been passed therethrough. The ratio of the amount of absorbent in the B layer 504*b* to that of the A layer 504*a* in the absorbent layer 504 of this embodiment was 2:1. Sample 1 denotes the adsorption ability of a canister of the type shown in FIG. 3. Sample 2 represents the adsorption ability of the canister 500 of this embodiment in which the ratio of the amount of absorbent in the B layer 504*b* to that of the A layer 504*a* is set at 1:1. Sample 3 designates the adsorption ability of the canister 500 of this embodiment in which the ratio of the amount of absorbent in the B layer 504*b* to that of the A layer 504*a* is set at 2:1 which has no perforated diffusing members 505 or 506.

As is clear from FIG. 23, the adsorption efficiency is increased by about 25% as compared with that of Sample 1 when the canister includes the perforated diffusing members 505 and 506 and the ratio of the amount of absorbent in the B layer 504*b* to that in the A layer 504*a* is set to 2:1. Since a large volume of fuel vapor generated during a fuel filling operation is first adsorbed by the A layer 504*b* of the absorbent layer 504, and the remainder is the adsorbed by the A layer 504*a*, the adsorption rate of the absorbent layer gradually reduces along the flow of fuel vapor. Therefore, when the amount of absorbent located near the inlet of the fuel vapor is set at a value larger than that of the absorbent located downstream, the adsorption rate of the absorbent layer can be made uniform, and the adsorption efficiency of the absorbent layer can be further improved. Thus, in the present embodiment, it is possible to greatly improve the adsorption efficiency of the absorbent layer 504 by setting the ratio of the amount of absorbent in the B layer 504*b* located near the inlet port 512 to that in the A layer 504*a* located downstream at 1.5 to 2.5:1.

Figure 24:
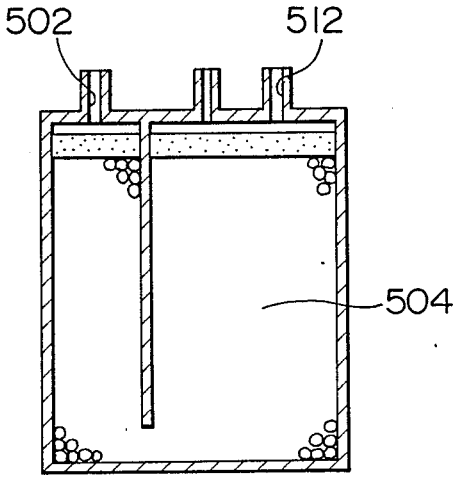
FIGS. 24 and 25 show modified examples of the canister of FIG. 22.
Figure 25:
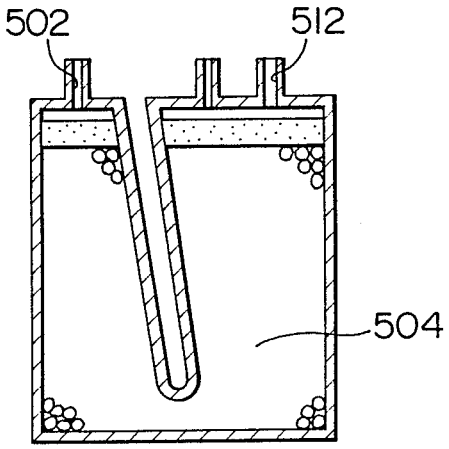

The adsorption rate of the absorbent layer 504 may also be made uniform so as to improve the adsorption efficiency by removing the second space 508 and by setting the amount of absorbent located near the inlet port 512 at a value larger than that of the absorbent located near the air port 502, as shown in FIGS. 24 and 25.

A sixth embodiment of the present invention will now be described with reference to FIG. 26.

A canister 600 includes an outer casing 602 and an inner casing 603, as in the case of the canister shown in FIG. 14. The canister 600 contains a first space 607, an absorbent layer 605, a second space 608, an absorbent layer 604, a third space 609, a filter 620, a filter 620, a filter 617, an upper retaining plate 614, a filter 619, a lower retaining plate 616, a filter 618, and an upper retaining plate 615.

Figure 26:
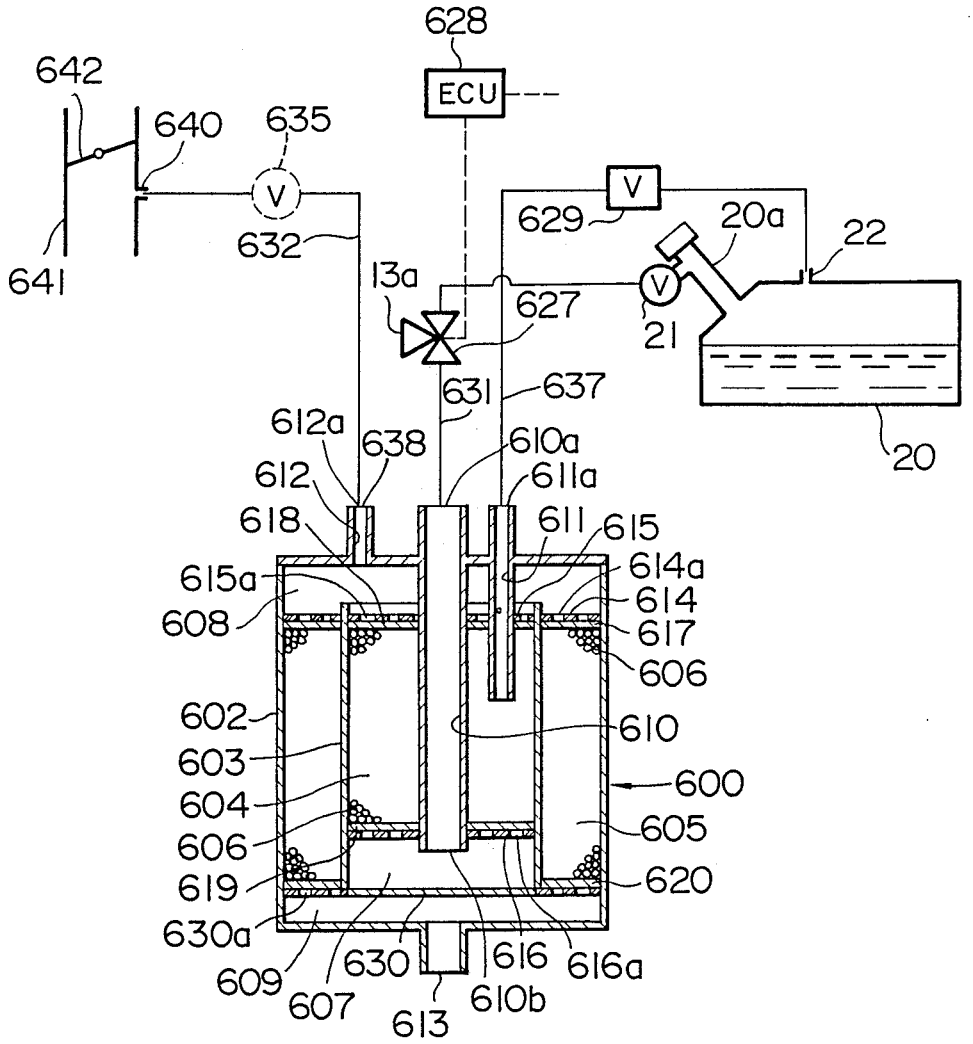
FIG. 26 is a cross-sectional view of a canister, showing a sixth embodiment of the present invention.

A first inlet pipe 610 and a second inlet pipe 611 are inserted into the outer casing 602 through the upper surface thereof as viewed in FIG. 26, and a purge port 612 is formed in the upper surface of the outer casing 602. One end 610*a* of the first inlet pipe 610 is connected to a fuel supply pipe 20*a* of the fuel tank 20 through a conduit 631, and the other end 610*b* thereof passes through the second space 608 and the absorbent layer 604, and opens to the first space 607. The second inlet pipe 611 has a smaller diameter than that of the first inlet pipe 610. One end 611*a* of the inlet pipe 611 is connected to the upper port 22 of the fuel tank 20 through a conduit 637, and the other end 611*b* thereof passes through the second space 608, and opens to the absorbent layer 604. The purge port 612 communicates with the second space 608. One end 612*a* of the purge port 612 is connected to a port 640 formed in a suction pipe 641 downstream a throttle valve 642. A throttle valve 638 having a diameter of about 0.6 mm to 1.0 mm is provided in the purge port 612.

The switch-over valve 21 which opens for a predetermined period of time during a fuel filling operation is provided in a portion of the conduit 631 which is connected to the fuel supply pipe 20*a* of the fuel tank 20. A three-way valve 627 is also provided in the conduit 631. The three-way valve 627 is switched over by a control circuit 628 in response to a signal representing the running state of the vehicle such as the amount of air which is input to the control circuit, such that it connects the fuel tank 20 and the first inlet pipe 610 or the atmosphere and the first inlet pipe 610.

A control valve 629 is provided in the conduit 637 so as to control the flow rate of the fuel vapor which flows into the second inlet pipe 611 from the fuel tank 20. A control valve 635 for controlling the flow rate of the fuel vapor which is drawn into the suction pipe 648 through the purge port 612 is provided in the conduit 632.

An air port 613 which is open to the atmosphere is formed in the lower surface of the outer casing 602 as viewed in FIG. 26.

Next, the operation of the sixth embodiment will be described below.

The fuel which is supplied to the fuel supply pipe 20*a* of the fuel tank 20 flows into the fuel tank 20 at a rate of about 30 to 40 l/min. At that time, the switch-over valve 21 is opened so as to allow the fuel vapor generated during a fuel filling operation to be introduced into the conduit 631.

The three-way electromagnetic value 627 is switched over by the control circuit 628 in response to the signal representing the state in which the fuel tank is filled with fuel such that it connects the fuel tank 20 and the first inlet pipe 610 of the canister 600, and the fuel vapor that flows into the conduit 631 is thereby introduced into the canister 600 through the first inlet pipe 610.

The fuel vapor introduced through the first inlet pipe 610 is discharged into the first space 607 from the open end 610*b* of the first inlet pipe 610. In the first space, the fuel vapor collides with the inner wall of a bottom surface portion 630 of the inner casing 603 which acts as a direction-changing plate, and diffuses therein uniformly. This results in a reduction in the flow rate of the fuel vapor. The distance between the open end 610*b* of the first inlet pipe 610 and the inner wall of the bottom surface portion 630 is set at about 6 mm.

Thereafter, the fuel vapor passes through perforations 616*a* formed in the lower retaining plate 616 and the filter 619, and then flows into the absorbent layer 604 where it is gradually adsorbed while flowing upwardly.

The fuel vapor which leaks out from the absorbent layer 604 enters the second space 608, diffuses therein, and is adsorbed by the absorbent layer 604.

The fuel vapor generated from the fuel stored in the fuel tank 20 is introduced into the second inlet pipe 611 through the upper port 22 and the conduit 637. The switch-over valve 629 is opened when the amount of fuel vapor that flows through the conduit 637 reaches a predetermined value. Since the flow rate of the fuel vapor which is generated from the fuel stored in the fuel tank 20 is lower than that of the fuel vapor generated during a fuel tank filling operation, the diameter of the second inlet pipe 611 is smaller accordingly, and the open end 611*a* of the second inlet pipe 611 directly opens into the absorbent layer 604. In consequence, the fuel vapor introduced through the second inlet pipe 611 is adsorbed by the absorbent layer 604.

When the engine is operated, a vacuum is generated in the suction pipe 641, and this causes evacuation of the canister 600 through the conduit 632 and the purge port 612. At that time, the three-way valve 627 is controlled by the control circuit 628 in accordance with the running state of the vehicle, e.g., it is switched over such that it connects the fuel supply pipe 21 and the first inlet pipe 610 at the initial stage of the fuel vapor removal operation or when the amount of air which is sucked is small and that it connects the atmosphere to the first inlet pipe 610 after a predetermined time has elapsed following starting of the removal operation or when the amount of air which is sucked is large.

As a result, at the initial stage of the fuel vapor removal operation or when the amount of air sucked is small, the air is introduced into the canister 600 from the air port 613 by virtue of the vacuum in the suction pipe, and the introduced air pass the third space 609, the absorbing material layer 605, and the first space 607 in that order, and thereby removes the fuel vapors mainly adsorbed to the absorbing material layer 605 having a lower adsorption rate. The removed fuel vapors flow into the purge port 612, then into the suction pipe 641 through the conduit 632. The flow rate of the fuel vapors which flow into the suction pipe 641 is adjusted by the control valve 635.

After a predetermined time has elapsed following staring of the removal operation and when the amount of air sucked is large, since the first inlet pipe 610 is connected to the atmosphere by the three-way valve 627, the air is introduced through both of the air port 613 and the first inlet pipe 610 by virtue of the vacuum in the suction pipe. The air introduced through the air port 613 passes through the third space 609, the adsorbent layer 605, and the second space 608 in that order, whereas the air introduced through the first inlet pipe 610 passes through the first space 607, the adsorbent layer 604, and the second space 608 in that order. This enables the fuel vapor adsorbed by the adsorbent layers 604 and 605 to be removed, and the removed fuel vapor flows into the purge port 612 then into the suction pipe 641 through the conduit 632. The flow rate of the fuel vapor that flows through the conduit 632 is adjusted by the control valve 635.

Figure 27:
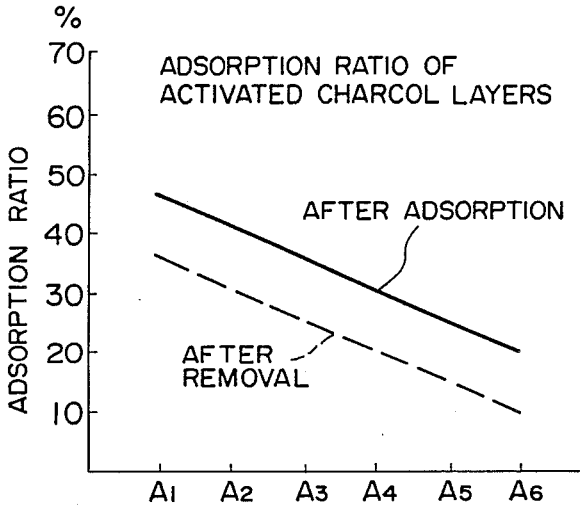
FIG. 27 shows the adsorption rate of an absorbent which is measured when the absorbent has adsorbed the fuel vapor and after the fuel vapor has been removed from the absorbent.
Figure 28:
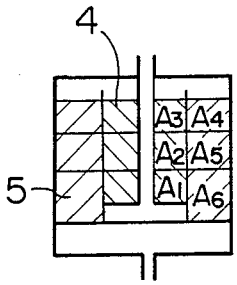
FIG. 28 illustrates the positional relationship of the absorbents shown in FIG. 27.

The adsorbent layers 604 and 605 of this embodiment were divided into six parts, as shown in FIG. 28, and the adsorption rates of the adsorbent in each of these six parts which adsorbed the fuel vapor and from which the fuel vapor was removed were respectively measured. FIG. 27 shows the results of this measurement. As is clear from the graph in FIG. 27, the adsorption rate of the adsorbent reduces along the flow of the large volume of fuel vapor generated during a fuel tank filling operation. It is also clear from the graph that the fuel vapor is substantially uniformly removed from the adsorbents in the six parts.

Figure 29:
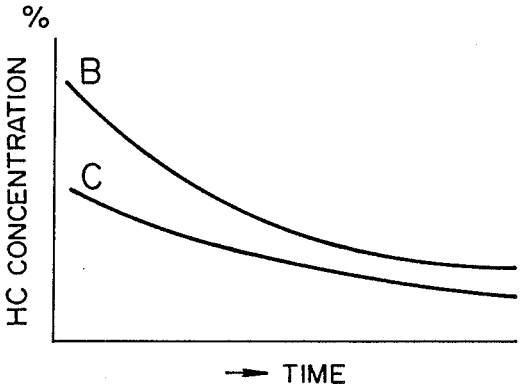
FIG. 29 shows the removal characteristics of the canister of FIG. 26.
Figure 30:
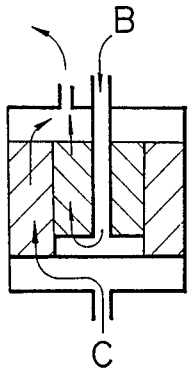
FIG. 30 shows the flows of fuel vapor removed from the absorbents which exhibit the removal characteristics of FIG. 29.

FIG. 29 shows the characteristics of the fuel vapor removed from the adsorbent layer 604 (in the manner indicated by the arrow B in FIG. 30) and those of the fuel vapor removed from the adsorbent layer 605 (in the manner indicated by the arrow C in FIG. 30). As is clear from the graph of FIG. 29, the concentration of the hydrocarbons contained in the fuel vapor removed from the adsorbent layer 60*r* is high, while that of the fuel vapor removed from the adsorbent layer 605 is low. This enables the HC concentration to be controlled in accordance with the running state of the vehicle by the control of the three-way valve 627.

The three-way valve 627 may also be switched over by the control circuit 628 in response to a signal representing the amount of air which is sucked, the presence or non-presence of the vacuum in the suction pipe, the amount of fuel remaining in the fuel tank 20, the temperature of a cooling water, the amount of oxygen in an exhaust, the position of a throttle valve, the engine speed or the amount of fuel ejected.

In the above-described embodiment, the three-way valve 627 is switched over by the control circuit 628. However, a pressure valve which is activated by the vacuum in the suction pipe may also be used to control the three-way valve 627.

Next, a seventh embodiment of the present invention will be described below with reference to FIG. 31.

A canister 700 includes an outer casing 702, and an inner casing 703, as in the case of the canister shown in FIG. 14. It has a first space 707, a second space 708, and a third space 709, and contains an adsorbent layer 705, an adsorbent layer 704, a filter 720, a filter 717, an upper retaining plate 714, a filter 719, a lower retaining plate 716, a filter 718, and an upper retaining plate 715.

Figure 31:
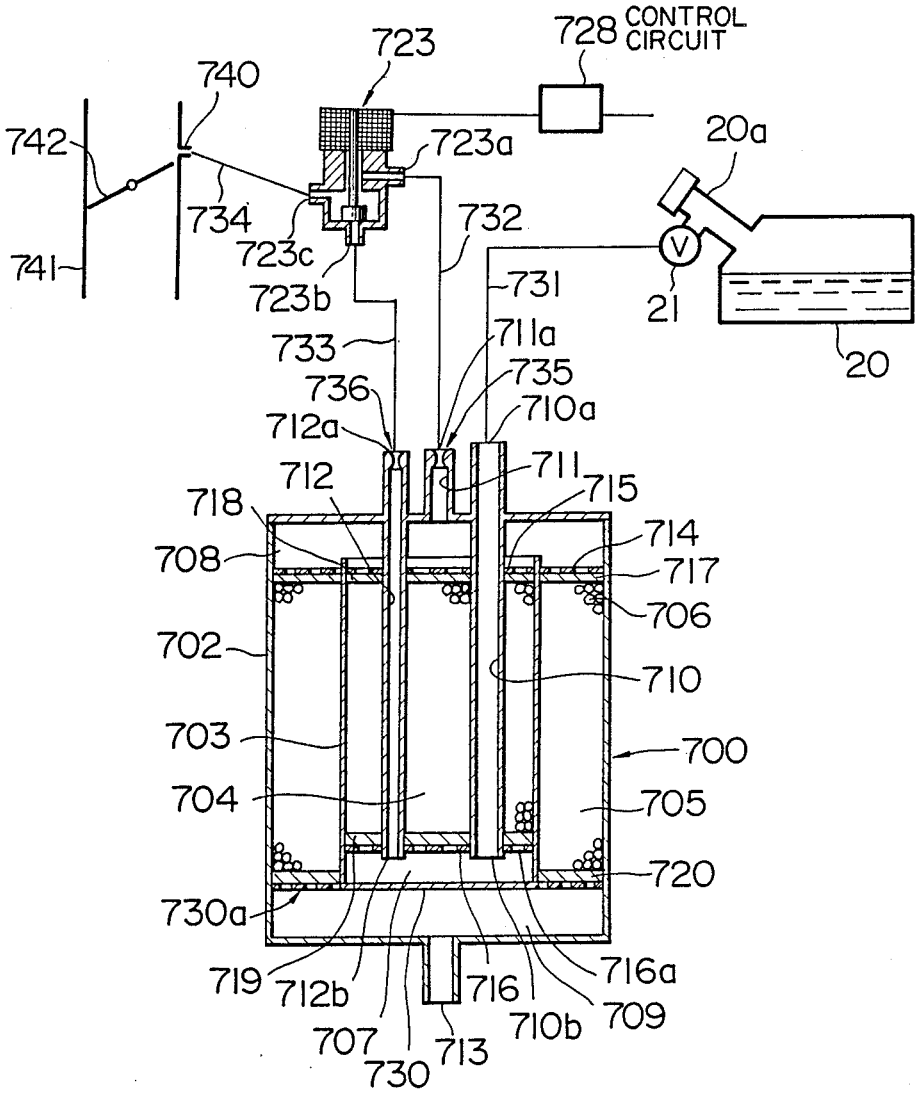
FIG. 31 is a cross-sectional view of a canister, showing a seventh embodiment of the present invention.

An inlet pipe 710 and a second purge pipe 712 are inserted into the outer casing 702 through the upper surface thereof as viewed in FIG. 31. A first purge port 711 is formed in the upper surface of the outer casing 702. One end 710*a* of the inlet pipe 710 is connected to the fuel supply pipe 20*a* of the fuel tank 20 through a conduit 731, and the other end 710*b* thereof passes through the second space 708 and the adsorbent layer 704, and opens to the first space 708. One end 711*a* of the first purge port 711 which communicates with the second space 708 is connected to a port 723*a* of an electromagnetic valve 723 through a conduit 732. One end 712*a* of the second purge pipe 712 is connected to a port 723*b* of the electromagnetic valve 723 through a conduit 733, and the other end 712*b* thereof passes through the second space 708 and the adsorbent layer 704, and opens to the first space 707. Contracted portions 735 and 736 having a diameter ranging between 0.6 mm and 1.0 mm are respectively provided in the first purge port 711 and the second purge pipe 712.

The electromagnetic valve 723 also has a port 723c which communicates with a port 740 formed in a suction pipe 741 upstream a throttle valve 742. It is switched over by a control circuit 728 in response to a signal representing the running state of the vehicle such as the amount of air sucked, and thereby connects the port 723c to the port 723a or to the port 723b.

The switch-over valve 21 which is opened for a predetermined period of time during a fuel filling operation is provided in a portion of the conduit 731 which is connected to the fuel supply pipe 20a of the fuel tank 20.

The lower surface of the outer casing 702 as viewed in FIG. 31 is provided with an air port 713 which is open to the atmosphere.

Next, the operation of the seventh embodiment will be described below.

The fuel which is supplied to the fuel supply pipe 20a of the fuel tank 20 flows into the fuel tank 20 at a flow rate of about 30 to 40 l /min. At that time, the switch-over valve 21 is opened so as to introduce the fuel vapor generated during a fuel fill operation into the canister 700 through the condudit 731.

The fuel vapor introduced through the inlet pipe 710 is discharged into the first space 707 from the open end 710b of the inlet pipe 710. The discharged fuel vapor collides with the inner wall of a bottom surface portion 730 of the inner casing 703 which serves as a direction-changing plate and diffuses uniformly in the space 707. This results in reduction in the flow rate of the fuel vapor. The distance between the open end 710b of the inlet pipe 710 and the bottom surface portion 730 is set at about 6 mm.

Subsequently, the fuel vapor passes through perforations 716a in the lower retaining plate 716 and the filter 719, and flows into the adsorbent layer 704 where it is adsorbed while flowing upwardly.

The fuel vapor which leaks from the adsorbent layer 704 enters the second space 708, diffuses therein, and is then adsorbed by the adsorbent layer 705. The fuel vapor discharged into the second space 708 may flow into the first purge port 711. However, a large part thereof flows into the adsorbent layer 705 having a small ventilation resistance due to the contracted portion 735 formed in the first purge port 711. Again, since the fuel vapor diffuses in the second space 708 and then enters the adsorbent layer 705, the adsorption efficiency of the adsorbent layer 705 is increased.

When the engine is operated, a vacuum is generated in the suction pipe 741 by the pivot of the throttle valve 742, and this vacuum acts on the port 723c of the electromagnetic valve 723 through the port 740 and the conduit 734. At that time, the electromagnetic valve 723 is switched over by the control circuit 728 in accordance with the running state of the vehicle. That is, the electromagnetic valve 723 is controlled such that it opens a passage between the port 723c and the port 723a at the initial stage of the removal operation or when the amount of air sucked is small and that it opens a passage between the port 723c and the port 723b after a predetermined period of time has elapsed following staring of the removal operation or when the amount of air sucked is large.

As a result, at the initial stage of the removal operation or when the amount of air sucked is small, the air which is introduced into the canister 700 through the air port 713 by virtue of the vacuum in the suction pipe passes through the third space 709, the adsorbent layer 705, and the second space 708 in that order, and thereby removes the fuel vapor mainly adsorbed by the adsorbent layer 705 having a lower adsorption rate. The removed fuel vapor passes through the first purge port 711, the conduit 732, the port 723a, the port 723c and the port 740 in that order, and is drawn into the suction pipe 741.

Figure 32:
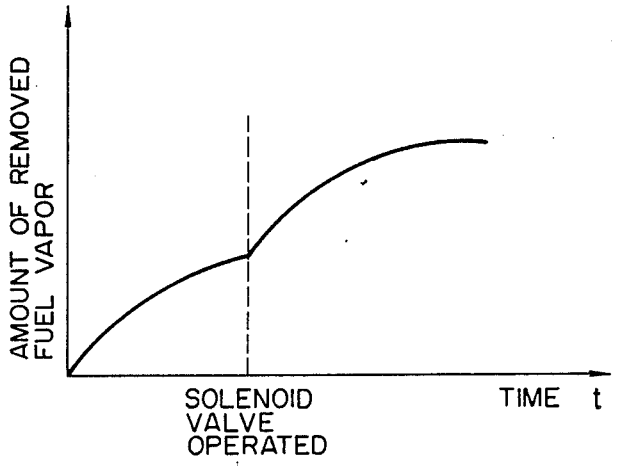
FIG. 32 shows the relationship between the time which elapses and the quantity of fuel vapor which is removed.

In a case where the amount of air sucked is large after a predetermined period of time has elapsed following starting of the the removal operation, the electromagnetic valve 723 opens a passage between the port 723c and the port 723b. Therefore, the air which is introduced into the canister 700 through the air port 713 by virtue of the vacuum in the suction pipe passes through the third space 709, the adsorbent layer 705, the second space 708, the adsorbent layer 704, and the first space 707 in that order, and thereby removes the fuel vapor mainly adsorbed by the adsorbent layer 704 having a higher adsorption rate. The removed fuel vapor passes through the second purge port 712, the conduit 733, the port 723b, the port 723c, and the port 740 in that order, and is then drawn into the suction pipe 741. FIG. 32 shows the relationship between the time t and the amount of fuel vapor which is removed from the adsorbent.

Figure 33:
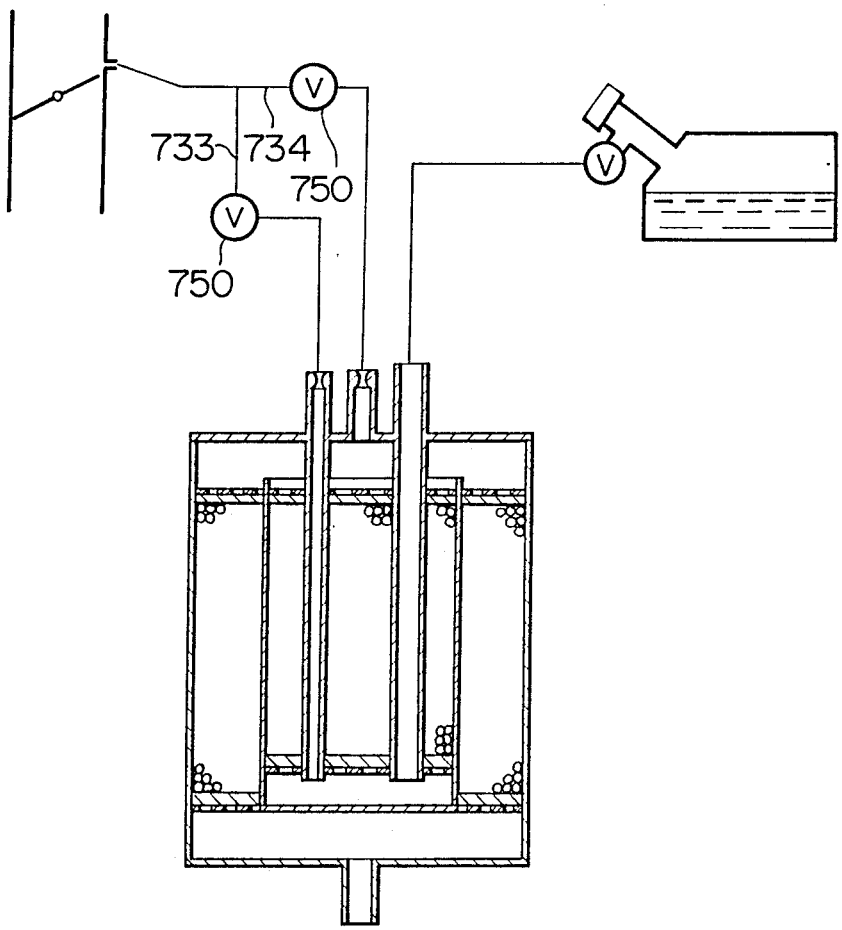
FIG. 33 shows a modified example of the canister of FIG. 31.

In the present embodiment, connection of the purge port to the port 740 is switched over by the electromagnetic valve 723. However, change-over of the connection of the purge port to the port 740 may also be conducted using valves 750 and 751 provided in the conduits 733 and 734, respectively, as shown in FIG. 33.

Figure 34:
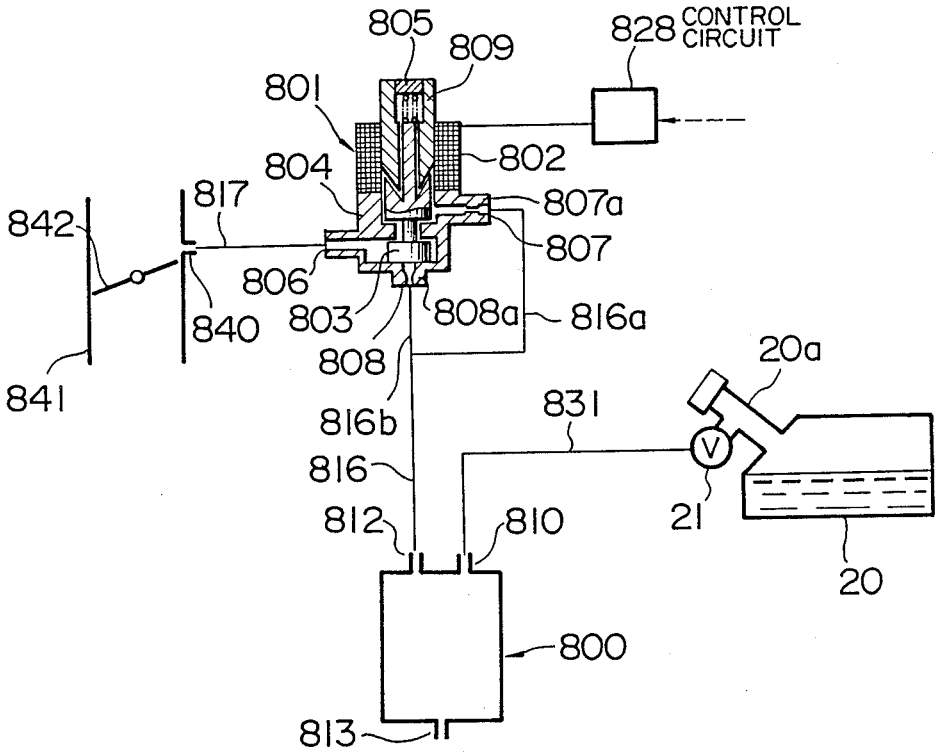
FIG. 34 is a schematic view of a canister, showing an eighth embodiment of the present invention.

Next, an eighth embodiment of the present invention will be described below with reference to FIG. 34.

A canister 800 has a purge port 812, an inlet port 810, an air port 813, and a diffusing chamber (not shown) where the fuel vapor introduced through the inlet port 810 is diffused.

The inlet port 810 communicates with the fuel tank 20 via a conduit 831. The switch-over valve 21 which is opened for a predetermined period of time during a fuel tank fill operation is provided in a portion of the conduit 831 which is connected to the fuel supply pipe 20a of the fuel tank 20.

An electromagnetic valve 801 includes a first casing 804, a second casing 809, a valve body 803, an electromagnetic coil 802, and a spring 805. The purge port 812 of the canister 800 communicates with the electromagnetic valve 801 through a conduit 816 which is bifurcated into a conduit 816a that connects the purge port 812 to a first port 807 formed in the first casing 809, and a conduit 816b which connects the purge port to a second port 808 formed in the first casing 809. Contracted portions 807a and 808a are formed in the first port 807 and the second port 808, respectively. The diameter of the contracted portion 807a in the first port 807 is smaller than that of the contracted portion 808a in the second port 808. The first casing 804 is also provided with a third port 806 which communicates through a conduit 817 with a port 840 which opens to a suction pipe 841.

The valve body 803 is movably disposed in the first and second casings 804 and 809. Communication between the first port 807 and the third port 806 or communication between the second port 808 and the third port 806 is selected by the movement of the valve body 803. The valve body 803 is normally urged by the spring 805. Therefore, in a state where the electromagnetic coil 802 is not energized, the second port 808 is closed by the valve body 803, resulting in the communication between the first port 807 and the third port 806. When the electromagnetic coil 802 is energized, the valve body 803 moves against the urging force of the spring 805 by virtue of the magnetic force generated, disconnecting the first port 807 and the third port 806 and connecting the second port 808 and the third port 806.

The control circuit 828 receives a signal representing any state of the vehicle such as the amount of air sucked, and controls the electromagnetic valve 801 on the basis of the signal input.

The operation of the eighth embodiment of the present invention will be described below.

The fuel which is supplied to the fuel supply pipe 20*a* of the fuel tank 20 flows into the fuel tank. At that time, the switch-over valve is opend so as to allow the generated fuel vapor to flows into the conduit 831.

The fuel vapor which flows into the conduit 831 is introduced into the canister 800 through the inlet port 810, and is adsorbed by a fuel vapor adsorbent (not shown) incorporated in the canister 800.

When the engine is operated, a vacuum is generated in a suction pipe 841 by the pivot of a throttle valve 842, and this vacuum acts on the third port 806 of the electromagnetic valve 801 through a port 840 and a conduit 817. At that time, the electromagnetic valve 801 is controlled by a control circuit 828 in accordance with the running state of the vehicle. That is, the electromagnetic valve 801 is not energized and thereby connects the first port 807 and the third port 806 at the initial stage of the fuel vapor removal operation or when the amount of air sucked is small. After a predetermined period of time has elapsed following starting of the removal operation and when the amount of air sucked is large, the electromagnetic valve 801 is energized by the control circuit 828, and thereby connects the second port 808 to the third port 806.

As a result, at the initial stage of the removal operation or when the amount of air sucked is small, the air is introduced into the canister 800 through the air port 813 by virtue of the vacuum in the suction pipe so as to remove the fuel vapor adsorbed by the adsorbent (not shown) in the canister 800. The removed fuel vapor passes through the purge port 812, the conduit 816, the conduit 816*a*, the first port 807, the third port 806, the conduit 817, and the port 840 in that order, and is then drawn into the suction pipe 841. The flow rate of the fuel vapor which is drawn into the suction pipe 84*a* is reduced by the contracted portion 807 in the first port 807.

In a case where the amount of air sucked is large, the removed fuel vapor passes through the purge port 812, the conduit 816, the conduit 816*b*, the second port 808, the thrid port 806, the conduit 817 and the port 840 in that order after a predetermined period of time has elapsed following starting of the removal operation, and is then drawn into the suction pipe 841. At that time, the flow rate of the fuel vapor is reduced by the contracted portion 808*a* in the second port 808. As has been stated, since the contracted portion 808*a* in the second port 808 has a larger diameter than that of the contracted portion 807*a* in the first port 807, a larger quantity of fuel vapor is drawn into the suction pipe 841 through the port 808. This means that the flow rate of the fuel vapor drawn into the suction pipe 841 can be controlled in accordance with the running state of the vehicle by controlling the electromagnetic valve 801, so as to prevent variations in the air/fuel ratio.

Even if the control circuit 828 for controlling the the electromagnetic valve 801 fails, the valve body 803 of the electromagnetic valve 801 is urged by the spring 805, and the communication between the first port 807 and the third port 806 is therefore maintained. Therefore, at the initial stage of the removal operation or when the amount of air sucked is small, that is, when the flow rate of the fuel vapors is defined by the contracted portion 807*a* in the first port 807, fuel vapor is drawn into the suction pipe from the canister 800 at a minimum flow rate, and degradation of the ability with which the canister 800 adsorbs fuel vapor can be prevented.

Figure 35:
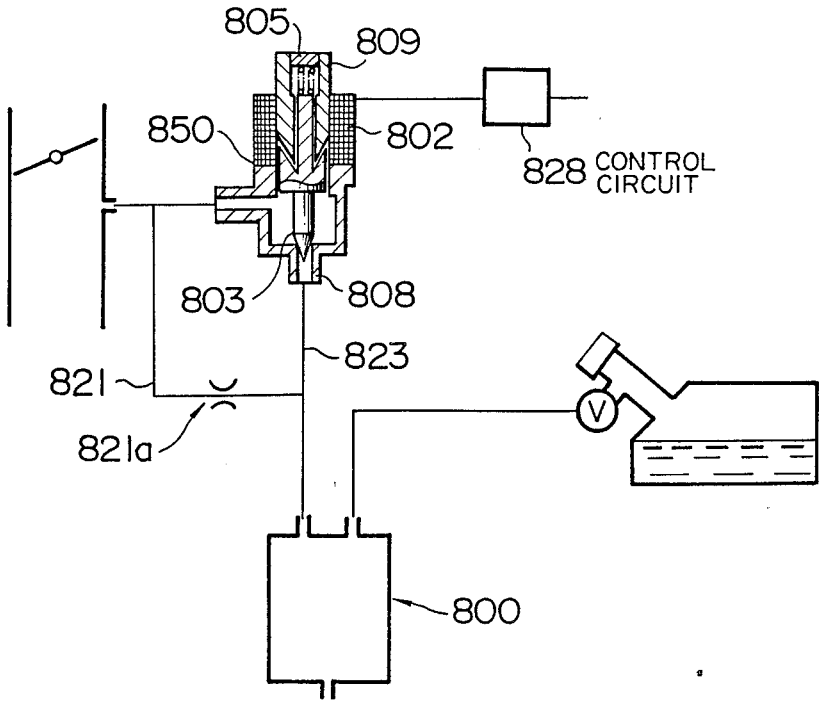
FIG. 35 shows a modified example of the canister of FIG. 34.

In this embodiment, the electromagnetic valve 801 is controlled such that it connects the first port 807 and the third port 806 while it is not energized and that it connects the second port 808 and the third port 806 when it is energized. However, this construction may be replaced by a structure shown in FIG. 35. In the structure shown in FIG. 35, a conduit 821 which communicates with the purge port 812 is formed parallel to a conduit 823. The conduit 821 has a contracted portion 821*a*, and a proportionally controlled valve 850 for proportionally controlling the flow rate of the fuel vapor drawn into the suction pipe 841 in accordance with the running state of the vehicle by the control of the quantity of current supplied thereto may be incorporated in the conduit 823. Even if the control circuit 828 for controlling the proprotionally controlled valve 850 fails, the fuel vapor is drawn into the suction pipe 84*a* from the canister 800 at a minimum flow rate which is defined by the contracted portion 821*a*, and degradation of the capability with which the canister 800 adsorbs the fuel vapor can be prevented.

Figure 36:
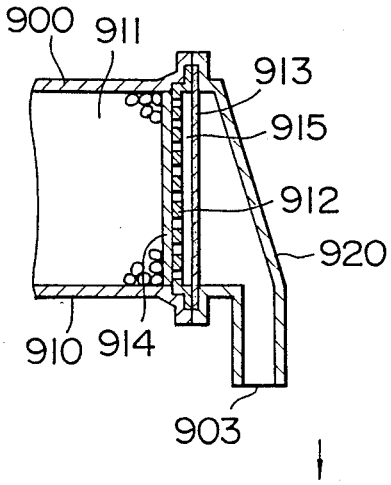
FIG. 36 is a cross-sectional view of essential parts of a canister, showing a ninth embodiment of the present invention.

A ninth embodiment of the present invention will be described below with reference to FIG. 36.

A canister 900 includes a main casing 910 and a second casing 920 with an air port 903 formed therein. The main casing 910 incorporates an adsorbent 911. The main casing 910 has an inlet port (not shown) through which fuel vapor is introduced into the casing, and a diffusing chamber (not shown) formed at the portion of the main casing to which the inlet port opens.

A grid 912 and a perforated membrane 913 are fixedly interposed between the main casing 910 and the second casing 920, by which the grid 912 retains the adsorbent 911 through a filter 914. The perforated membrane 913 is formed of a material (e.g., Boafleon manufactured by Sumitomo Denko) which readily penetrates air but does not pass water contents. The perforated membrane 913 and the grid 912 are separated from each other by a space 915 of a predetermined size. The open end of the air port 903 formed in the second casing 920 is directed toward the ground in a state where the canister 900 is mounted on a vehicle.

With the above-described arrangement, the water contents which have entered the canister 900 through the air port 903 are prevented from entering the main canister 910 by the perforated memberane 913. The water liquified from the water contents is discharged from the air port 903 directed toward the ground, preventing degradation of performance of the adsorbent 911 caused by the water contents entering it.

As has been stated, since the grid 912 retains the adsorbent 911 with the filter 914 therebetween, the perforated membrane 913 can be protected against the force of the adsorbent 912 which acts thereon when the vehicle is vibrated. Clogging of the perforated membrance 913 caused by the fine powders of the adsorbent 911 can also be prevented by the filter 914. Further, since the perforted membrane 913 and the grid 912 are provided with the space 115 therebetween, the ventilation area of the perforated membrane 913 can be secured, reducing the ventilation resistance of the perforated membrane 913. A perforated membrane 913 having a bore size of about 5 μm may be preferable with the relationship between the water-resistance and ventilation resistance being taken into consideration.

Figure 37:
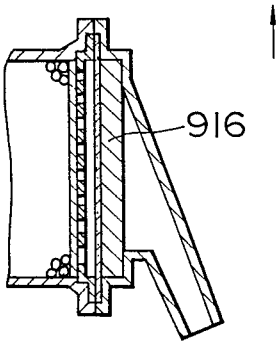
FIG. 37 shows a modified example of the canister of FIG. 36.

In a normal vehicle running environment, entering of sand and dust in addition to water contents is possible. Therefore a filter 916 for blocking the sand and dust may also be provided, as shown in FIG. 37.

In all of the described embodiments of the invention, a heat accumulating material, which is preferably of a latent heat type, may be embedded in the adsorbent to further improve the adsorbing and removing efficiencies of the adsorbent.

What is claimed is:

1. A fuel vapor treatment apparatus for a vehicle comprising:

a casing in which a first space, a first fuel vapor adsorbent, a second space, a second fuel vapor adsorbent, and a third space are disposed in such a manner that they communicate with each other in succession, said casing having an inlet port which opens into said first space and which is connected to a fuel tank, an air port which opens into said third space which communicates with the atmosphere, and a purge port which opens into said first space and through which the fuel vapor adsorbed by said first and second fuel vapor adsorbent are drawn to enter a suction pipe by a vacuum in said suction pipe, wherein said first space acts as a diffusing chamber in which the fuel vapor introduced through said inlet port diffuses to allow a component of the fuel vapor velocity in the direction in which the fuel vapor is adsorbed by said adsorbent to be reduced, wherein said casing has a second purge port which opens into said first space and through which the fuel vapor adsorbed by said fuel vapor adsorbent is drawn to enter said suction pipe by virtue of the vacuum in said suction pipe, and a conduit which connects said purge port and said second purge port to said suction pipe which incorporates an opening means adapted to provide connection between said pipe and said second purge port which is switched-over in accordance with the running state of the vehicle.

2. A fuel vapor treatment apparatus for a vehicle comprising:

a casing in which a first space, a first fuel vapor absorbent, a second space, a second fuel vapor absorbent and a third space are disposed such that they communicate with each other in succession, said casing having an inlet port which opens into said first space and is connected to a fuel tank, an air port which opens into said third space and communicates with the atmosphere, and a first purge port which opens into said first space and through which the fuel vapor adsorbed by said first and second fuel vapor absorbent is drawn into a suction pipe by a vacuum therein, wherein said first space acts as a diffusing chamber in which the fuel vapor introduced through said inlet port diffuses so as to reduce a component of the fuel vapor velocity in the direction in which the fuel vapor is adsorbed in said absorbent, and wherein said casing has a second purge port which opens into said first space through which the fuel vapor adsorbed by said fuel vapor adsorbent is drawn into said suction pipe by the vacuum therein, and means for switching over communications between said suction pipe and said first purge port and between said suction pipe and said second purge port in accordance with the operating condition of the vehicle.

3. A fuel vapor processing apparatus for a vehicle according to claim 1, wherein said casing incorporates an electromagnetic valve for controlling the flow rate of the fuel vapor which is drawn into said suction pipe through said purge port in accordance with the running state of the vehicle.

4. A fuel vapor treatment apparatus for a vehicle according to claim 1, wherein said electromagnetic valve includes an electromagnetic coil and a valve body attracted to said coil by the energization of said coil, a radiator plate made of a heat conductive material being provided on the outer periphery of said electromagnetic coil in such a manner as to be buried in said first adsorbent.

5. A fuel vapor treatment apparatus for a vehicle according to claim 1, wherein a passageway which connects said purge port to said suction pipe incorporates a sub-canister containing an adsorbent which adsorbs a reduced amount of fuel vapor but removes fuel vapor more efficiently than said first and second adsorbents do.

6. A fuel vapor treatment apparatus for a vehicle according to claim 1, a passageway which connects a fuel tank to said inlet port incorporates a three-way valve for providing communication of said inlet port with said fuel tank or communication of said inlet port with the atmosphere which is changed-over in accordance with the running state of the vehicle.

7. A fuel vapor treatment apparatus for a vehicle according to claim 1, wherein said second space serves as a second diffusing chamber in which the fuel vapor which leaks into said second space from said first adsorbent is diffused so as to allow a component of the fuel vapor velocity in the direction in which the fuel vapor is adsorbed by said second adsorbent to be reduced.

8. A fuel vapor treatment apparatus for a vehicle according to claim 7, wherein the direction in which the fuel vapor leaks into said second diffusing chamber from said first adsorbent is substantially opposite to that in which the fuel vapor is adsorbed by said second adsorbent.

9. A fuel vapor treatment apparatus for a vehicle according to claim 2, further including conduit means connecting said first and second purge ports to said suction pipe, said switching means being disposed in said conduit means.

* * * * *